US010465408B2

(12) United States Patent
Garcia, III et al.

(10) Patent No.: US 10,465,408 B2
(45) Date of Patent: Nov. 5, 2019

(54) VEHICLE VENDING MACHINE

(71) Applicant: Carvana, LLC, Tempe, AZ (US)

(72) Inventors: Ernest C. Garcia, III, Phoenix, AZ (US); Bret Sassenberg, Tempe, AZ (US); Benjamin E. Huston, Phoenix, AZ (US)

(73) Assignee: Carvana, LLC, Tempe, AZ (US)

( * ) Notice: Subject to any disclaimer, the term of this patent is extended or adjusted under 35 U.S.C. 154(b) by 0 days.

(21) Appl. No.: 16/257,863

(22) Filed: Jan. 25, 2019

(65) Prior Publication Data

US 2019/0153739 A1 May 23, 2019

Related U.S. Application Data

(63) Continuation-in-part of application No. 16/153,046, filed on Oct. 5, 2018, which is a continuation of application No. 15/691,305, filed on Aug. 30, 2017, now Pat. No. 10,094,131.

(60) Provisional application No. 62/381,655, filed on Aug. 31, 2016.

(51) Int. Cl.
*E04H 6/42* (2006.01)
*E04H 6/12* (2006.01)

(52) U.S. Cl.
CPC ..... *E04H 6/424* (2013.01); *E04H 6/12* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,154,897 | A | 4/1939 | Grant | |
| D223,485 | S | 4/1972 | Mullen | |
| D273,228 | S | 3/1984 | Cotton | |
| D283,166 | S | 3/1986 | Gardner et al. | |
| D316,903 | S | 5/1991 | Poelvoorde | |
| D317,047 | S | 5/1991 | Poelvoorde | |
| D693,942 | S | 11/2013 | Varadiova | |
| 2004/0237421 | A1 | 12/2004 | Franz | |
| 2005/0220594 | A1* | 10/2005 | Haag | E04H 6/22 414/529 |
| 2011/0213493 | A1 | 9/2011 | Stutz | |
| 2013/0144688 | A1 | 6/2013 | Jose | |
| 2017/0211287 | A1 | 7/2017 | Schmitt et al. | |

* cited by examiner

*Primary Examiner* — Kyle O Logan
(74) *Attorney, Agent, or Firm* — The Marbury Law Group, PLLC

(57) ABSTRACT

Systems, methods, non-transitory processor-readable storage media, and devices of the various embodiments enable a vehicle vending machine to retrieve a vehicle from a storage location and deliver the vehicle to a delivery bay for delivery to a customer. Various embodiments may include a vehicle vending machine including a tower, a robotic carrier, a corridor extending from the tower, a plurality of delivery bays positioned along the corridor, a customer interaction kiosk, and/or a video system.

9 Claims, 29 Drawing Sheets

VEHICLE VENDING MACHINE

RELATED APPLICATIONS

The present application is a continuation-in-part of U.S. Non-Provisional patent application Ser. No. 16/153,046 entitled "Vehicle Vending Machine" filed Oct. 5, 2018 which is a continuation of U.S. Non-Provisional patent application Ser. No. 15/691,305 entitled "Vehicle Vending Machine" filed Aug. 30, 2017 which claims the benefit of priority to U.S. Provisional Application No. 62/381,655, entitled "Vehicle Vending Machine" filed Aug. 31, 2016. The entire contents of all three applications are hereby incorporated by reference.

BACKGROUND

Typically, the provisioning of vehicles to customers is a space-intensive endeavor requiring large surface parking lots. The process of getting vehicles from the outdoor parking lots to the customers is a labor-intensive process requiring a driver to traverse the distance of the surface parking lot, find the desired vehicle, and drive the vehicle to the customer.

SUMMARY

The systems, methods, non-transitory processor-readable storage media, and devices of the various embodiments enable a vehicle vending machine to retrieve a vehicle from a storage location and deliver the vehicle to a delivery bay for delivery to a customer. Various embodiments may include a vehicle vending machine including a tower, a robotic carrier, a corridor extending from the tower, a plurality of delivery bays positioned along the corridor, a customer interaction kiosk, and/or a video system.

Various embodiments may include a vehicle vending machine, having a first delivery bay, and a tower comprising a series of storage locations on different vertically arranged levels, wherein at least a portion of the series of storage locations are on at least one of the different vertically arranged levels of the tower that is vertically offset from the first delivery bay. In various embodiments, the vehicle vending machine may further include a first robotic carrier configured to move a vehicle pallet between the tower and the first delivery bay. In various embodiments, the vehicle vending machine may further include a second delivery bay; and a second robotic carrier configured to move a vehicle pallet between the tower and the second delivery bay. In various embodiments, the first robotic carrier and the second robotic carrier each include a respective delivery hitch configured to move a vehicle pallet. In various embodiments, the second delivery bay may be oriented ninety degrees to the first delivery bay relative to the tower. In various embodiments, the first delivery bay may further include a personnel door and a delivery bay exterior door, wherein the personnel door and the delivery bay door are separate accesses to the first delivery bay from outside the vehicle vending machine. In various embodiments, the vehicle vending machine may further include a vehicle preparation area, an exterior door providing access to the vehicle preparation area from outside the vehicle vending machine, and a tower loading door providing access to the tower from the vehicle preparation area. In various embodiments, the series of storage locations are each configured to store and display a vehicle.

Further embodiments include a control system for a vehicle vending machine. Further embodiments include a method of operating a vehicle vending machine. Further embodiments include a non-transitory processor-readable storage medium having stored thereon processor-executable software instructions configured to cause a processor of a vehicle vending machine to perform various operations.

BRIEF DESCRIPTION OF THE DRAWINGS

The accompanying drawings, which are incorporated herein and constitute part of this specification, illustrate exemplary embodiments of the invention, and together with the general description given above and the detailed description given below, serve to explain the features of the invention.

DETAILED DESCRIPTION

Figure 1A:
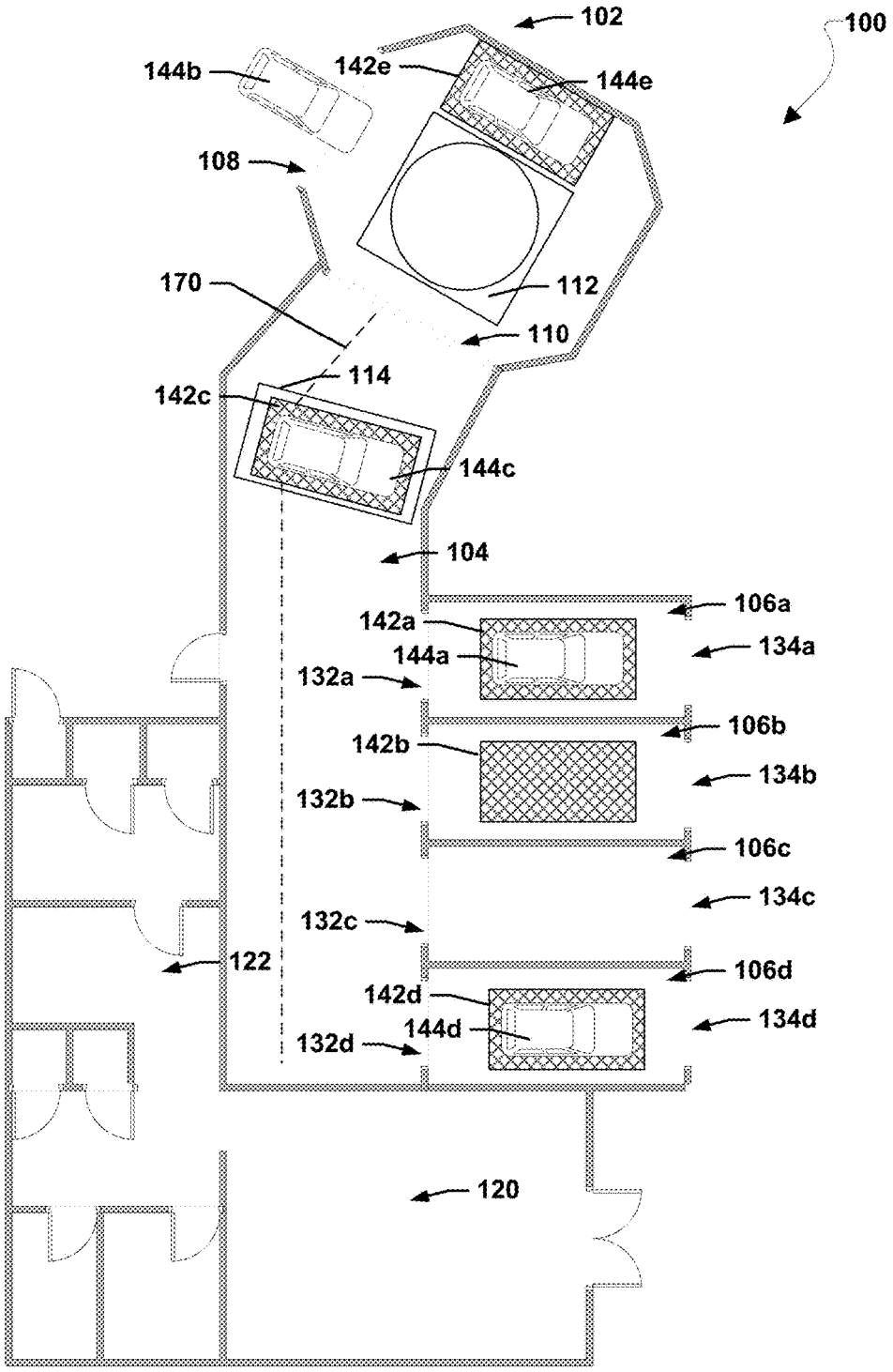
FIG. 1A is a block diagram of an example of a vehicle vending machine according to various embodiments.

Various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the claims.

Various embodiments provide systems, methods, devices, and non-transitory media for a vehicle vending machine. In various embodiments, the vehicle vending machine may comprise one or more tower, one or more robotic carrier, one or more bay, one or more customer interaction kiosk, and/or one or more video system.

A vehicle vending machine may be utilized to retrieve a vehicle from a storage location and deliver the vehicle to a customer. In various embodiments, the vehicle may be retrieved from a storage location within a tower and placed on a robotic carrier. The robotic carrier may navigate to an appropriate delivery bay and place the vehicle in the delivery bay. A buyer may complete an authentication process and take delivery of the vehicle from the delivery bay.

The discussions of "cars" used herein are for illustrative purposes of example vehicles suitable for use with the various embodiments. Other vehicles, such as trucks, vans, etc., may be substituted in the various embodiments and the term "car" is not intended to limit the various embodiments.

Loading the Tower.

In various embodiments, the tower may be loaded from a door in the tower itself. The car may be driven from outside the tower onto a ramp that leads up to the tower and through the door at the base of the tower. There may be a hydraulic powered lift gate that bridges the gap between the doorway and a vehicle pallet. This vehicle pallet may be attached to a lift-able shuttle in an atrium at the center of the tower. In some embodiments, the door in the tower itself may be an external door leading outside the vehicle vending machine. In such embodiments, the tower may be directly loaded from the external door. In some embodiments, the door in the tower itself may be a door internal to the vehicle vending machine. In some embodiments, the door in the tower itself may be a tower loading door internal to the vehicle vending machine that may connect to a vehicle preparation area. The vehicle preparation area may be disposed between the tower loading door and an external door of the vehicle vending machine. The vehicle preparation area may be an area in which vehicles may be inspected and prepared prior to loading into the tower. The external door may be opened to enable vehicles to be driven into the vehicle preparation area from outside the vehicle vending machine and/or from the vehicle preparation area out of the vehicle vending machine. The tower loading door may be an automatic door controlled to remain closed while the tower is in operation. Once a vehicle is ready in the vehicle preparation area, the tower loading door may be opened and the vehicle may be driven from the vehicle preparation area through the tower loading door and through a loading area of the tower onto a vehicle pallet. In the loading area of the tower may be a hydraulic powered lift gate that bridges the gap between the tower loading door and a vehicle pallet. This vehicle pallet may be attached to a lift-able shuttle in an atrium at the center of the tower.

Once the vehicle is set in the middle of the pallet, a command may be sent to the tower directing it to lift to the appropriate level. In an embodiment, there may be five levels with four cars each, except for the bottom level which only has two. In other embodiments, less levels or more levels may be used. In some embodiments, there may be no car storage positions at the bottom level. After the pallet is lifted up to the appropriate level, it may be rotated to the correct orientation. The pallet, which may be secured to the arms of the shuttle lift, may be pushed in to its assigned position in the tower. Once the pallet is in position, the arms may disengage from the pallet.

In various embodiments, the lifting mechanism may use chains that run up the sides of the tower, as well as a counterbalancing system with weights. Other lifting mechanisms, including hydraulics or gears, may also be used.

Retrieving a Vehicle from the Tower.

In various embodiments, the process for retrieving a vehicle from the tower may be similar to the system for loading a vehicle into the tower. A command may be sent to the shuttle identifying the storage slot where the desired vehicle is located. The command may be sent from a processor of a control system. The shuttle may be lifted up to the level of the identified storage slot. The shuttle may be rotated to orient itself to be aligned with the storage slot. Arms from the tower may hook onto the desired pallet and then lift the pallet clear of metal pegs which engage the pallet. The pallet may be transposed to be over the shuttle and the pallet may be lowered onto the shuttle. The shuttle may then be lowered to the lowest level, and rotated to orient itself with an entrance to an internal alleyway or corridor. In various embodiments, the internal alleyway or corridor may be a transfer area through which an automatic delivery system transfers the pallet with the vehicle on it to a pick-up bay (also referred to as a delivery bay). In some embodiments, there may be more than one internal alleyway or corridor connected to the tower. For example, there may be two internal alleyways or corridors, more than two internal alleyways or corridors, etc. In a specific embodiment, there may be two internal alleyways or corridors offset by ninety degrees to one another relative to the tower leading to two separate bays with orientations offset ninety degrees to one another. In various embodiments, the corridor may be of any length or shape. For example, the corridor may be forty feet or greater in length, or may be less than forty feet in length, such as only a few feet in length (e.g., the length of a pallet width (such as approximately eight feet in length), less than the length of a pallet width (e.g., one foot in length), etc.). For example, the corridor may have a straight-line shape, curved shape (e.g., a dog-leg left or right), etc. In various embodiments, the corridor may be a portion of the delivery bay itself, such as the portion connecting the delivery bay to the tower.

In some embodiments, an automatic robotic carrier may wait in the alleyway. Once the shuttle is on the lowest level and aligned with the robotic carrier, the pallet may be pushed from the shuttle onto the robotic carrier. Once in place, the arms may disconnect from the pallet. The robotic carrier also may have metal pegs that engage holes in the pallet, securing the pallet in place.

The Robotic Carrier.

In various embodiments, the robotic carrier may move on wheels. The robotic carrier may include a computer with a pre-programmed model of the alleyway dimensions and the robotic carrier may use lasers to locate reflective tape placed on the walls of the alleyway to determine the robotic carrier's location within the model. The robotic carrier may receive a message directing the robotic carrier to one of the delivery or customer pick-up bays. In an embodiment, there may be three bays, although there may be any number of bays, for example selected depending on size constraints and need. The robotic carrier may operate wheels according to the pre-programmed model and the robotic carrier may monitor a position of the robotic carrier using lasers and the reflective tape to accurately place the robotic carrier within the computerized model (called a "field"), to make sure that the robotic carrier doesn't run into any walls, and to ensure that the robotic carrier makes it to the appropriate bay. The model may also indicate to the robotic carrier when the robotic carrier should turn to enter the designated bay. Once the robotic carrier enters the bay, a lift engages the pallet and lifts the pallet up to a height that's level with the bay's floor, which may be above the elevation of the alleyway floor. Once the pallet is lifted to the level of the bay floor, the pallet may be secured in place. A platform between the back of the vehicle and back doors may raise and lock in place.

The Pick-Up Bay (Also Referred to as a Delivery Bay).

In various embodiments, after the pallet is secured in the pick-up bay, a signal may be sent to the bay doors that causes the rear doors that lead to the alleyway to close, and allows the front doors to open and customers to enter. In other embodiments, there may be no door (or doors) between the corridor and the pick-up bay. In some embodiments, the customer or employee may inspect the vehicle, and if it is to his or her satisfaction, the customer or an employee may enter the car and drive it out of the bay onto the street and/or other delivery areas outside the vehicle vending machine. In various embodiments, after the pallet is secured in the pick-up bay, a sliding external door of the bay may be unlocked and opened automatically. The bay may include a personnel door separate from the sliding external door. In some embodiments, an employee may open the personnel door and enter the bay via the personnel door. The employee may enter the vehicle on the pallet in the bay and drive the vehicle outside the delivery bay and out of the vehicle vending machine. After the vehicle is driven out of the bay, the sliding external door may close.

Retrieving the Pallets.

After the vehicle has been removed from the bay, the door may close. Once the door is closed, a command may be sent (e.g., by an interaction of an employee with a control system, automatic door-close signal, etc.) to the robotic carrier, and the robotic carrier may receive a signal indicating that there are no humans or other obstructions in the bay. First the back doors may open and the back platform may lower such that the robotic carrier enters the bay and places itself underneath the pallet. The pallet may be lowered onto the robotic carrier, secured by metal pins on the pallet that engage holes in the pallet. The robotic carrier may then carry the pallet back to the tower, where another vehicle is either loaded onto it, or it is placed in an empty storage slot in the tower.

The Customer Experience.

In various embodiments, a customer may arrive at a reception area adjacent to the tower alleyway, with a glass window that allows a view into the alleyway. An employee may verify the customers purchase and may give the customer a coin that is encoded with an RFID device. The customer may then drop the coin into a slot (e.g., a slot of a customer interaction kiosk), which includes a device that detects RFID signals. When the coin passes through the slot device, the RFID device in the coin may be detected and the unique identification may be decoded. A computer system may then look up the unique identification in a database to confirm that it corresponds to a vehicle that was purchased and that is located in the tower. If the vehicle is in the tower, the computer then sends a signal with the position number where the car is located, instructing the tower to retrieve the vehicle in that position and move it to an open bay.

Alternate Track System.

In various embodiments, the system may use a track or rail system rather than a self-driving robotic carrier. In such embodiments, the robotic carrier may be a carrier that moves along the track or rail system. In such a track or rail embodiment, the carrier may be placed on tracks or rails and may move along the alleyway using the tracks or rails that are secured to the floor. Each bay also may have a pair of tracks or rails that extend perpendicular or nearly perpendicular to the alleyway tracks or rails. There is a junction where the bay tracks or rails and the alleyway tracks or rails meet, which may allow the carrier to either continue down the alleyway tracks or rails or turn to engage the bay tracks or rails, depending on how the junction is configured. Where the last bay and the alley way tracks or rails intersect there may not be a junction but a curved track or rail that diverts the track or rail to connect the end of the alleyway track or rail and the last bay's track or rail.

In various embodiments that use the track or rail system, the carrier may have a separate pallet called a bay pallet. The carrier may carry the bay pallet underneath the pallet on which the car sits, called the tower pallet. The bay pallet engages and secures the tower pallet. Then the carrier carries the bay pallet, tower pallet, and car, until it is aligned with an empty bay. Using a telescoping process, the bay pallet and tower pallet are moved into the bay. The carrier then retracts the telescopic device, leaving the bay pallet, the tower pallet, and the car, in the bay for customer pick-up, and freeing the carrier to go retrieve another bay pallet from another bay and/or to go retrieve another tower pallet and car from the tower. The carrier may also include a rotating system to rotate the bay pallet and tower pallet to orient it with a bay.

Alternate Linear Delivery System.

In various embodiments, the robotic carrier may be a delivery hitch that may be a linear delivery system driven by a ball screw and guided by two track roller guide rails. This carrier that includes the delivery hitch may connect the tower to the delivery bay through the corridor. In the tower, the vehicles may be placed on top of pallets. The lifting mechanism of the tower may bring the vehicles on the pallet to the ground level. The vehicle and pallet may be transitioned from the turntable of the shuttle to the delivery hitch that may move the vehicle and pallet transversally along the track and roller guides into a selected delivery bay. In such embodiments, more than one carrier may be present in the vehicle vending machine, such as one carrier for each delivery bay. In such embodiments, each carrier may include its own two guide tracks, a delivery hitch, and a driven ball screw. In various embodiments, the delivery hitch may be connected to the guide tracks via four profiled track rollers on a shaft, and two flat track rollers onto the top of the guide track channel. There may be a guide track on two sides of the delivery hitch, and a ball screw that lies on the central axis of this carrier system. The delivery hitch may have six track rollers. Two track rollers may be steel ball bearings with a flat outer bearing contact surface. Four track rollers may be steel ball bearings with a profiled outer bearing contact surface to provide the hitch with lateral stability when paired with a shaft. The drive motor of the ball screw may have a built-in encoder, when paired with the pitch of the ball screw, that may provide constant knowledge of the position of the pallet on the carrier. The range of travel of the delivery hitch may be programmed into the system to prevent overtravel. There may be a proximity switch that detects when a pallet is properly loaded onto the delivery hitch. Once the pallet is positioned onto the delivery hitch, it will depress a spring-loaded steel plate that will position in front of the proximity switch. This switch may then send the "OK" signal to the system to proceed with delivery operations. The floor in the delivery bay may be leveled with the outside floor in a delivery area outside the vehicle vending machine. The corridor connecting the tower to the delivery bay may be prepared with a recess which will allow for the top of the pallet to be flush with the floor of the delivery bay. Additionally, the recessed portion of the delivery bay floor may have a pit that lies along the centerline of the bay which may house the carrier (e.g., house any one or more of the guide tracks, a delivery hitch, driven ball screw, etc.). The corridor may be configured not to be transited by any customers or employees. Once the pallet is correctly placed onto the carrier, a signal may be sent to the control system via a proximity sensor to initiate the remaining sequence to move the pallet into the delivery bay. Once this sequence is initiated, a ball screw drive may deliver the pallet down the corridor into the delivery bay into a "final position" which may be indicated by an embedded encoder inside of the ball screw drive motor. After the vehicle is driven off the pallet out of the delivery bay, a delivery bay sliding door may close and the carrier may reverse the delivery process to return the empty pallet to the tower through the corridor.

Automatic Video System.

In various embodiments, cameras may be placed at important vantage points in the tower, including at the following locations: (1) on the ceiling of the tower looking downward to capture a birds-eye view of the tower; (2) from within each storage slot in the tower looking at the side of the vehicle; (3) at the base of the tower, adjacent to the passage from the tower atrium to the alleyway, and looking across that passage; (4) from the far end of the alleyway, looking down the alleyway toward the passage to the tower; (5) from the portion of the pick-up bay closest to the street, looking back toward the passage from the pick-up bay to the alleyway; and/or (6) from within the pick-up bay, looking toward the portion closest to the street where customers will be looking on.

In various embodiments, these cameras may be constantly recording video and may be synchronized to a same clock. When a vehicle retrieval command is issued to the tower, the computer system may record timestamps of key events in the vehicle's retrieval, including: (1) when the vehicle is stationary in the storage slot; (2) when the vehicle is picked up by the tower shuttle; (3) when the vehicle is descending down the tower shuttle; (4) when the vehicle is placed on the robotic carrier; (5) when the vehicle is carried down the alley way by the robotic carrier; (6) when the vehicle enters the pick-up bay; and/or (7) when the doors to the entrance of the pick-up bay open to allow the customer to enter.

In various embodiments, the computer system may automatically retrieve the videos recording from specific cameras of specific times during their recording based on the timestamps recording corresponding to the vehicle's retrieval. For example, the computer system retrieves video from the aerial view of the tower from when the vehicle pallet first enters the tower atrium until its descent is complete.

In various embodiments, the computer system may then join these video segments together into one video, and optionally add a template introduction or conclusion to the video. The video may be stored on a server, and a link may be sent to the customer which allows a customer to download the video or share it on one of multiple social media sites, such as Facebook or YouTube.

FIG. 1A illustrates an example of a vehicle vending machine 100 according to various embodiments. Vehicle vending machine 100 may include a tower 102, a corridor 104, and a plurality of delivery bays 106*a*-106*d*. The tower 102 may include an exterior door 108 and an opening 110 positioned between the tower 102 and the corridor 104. The tower 102 may also include a lift-able shuttle 112 located within the center of the tower 102. Vehicle vending machine 100 may also include a lobby 120 and offices 122. One or more processors may be connected to the various motors, sensors, displays, cameras, and other equipment described herein that may be used in the vehicle vending machine to control such equipment to perform the operations described herein. The tower 102 may provide for the storage and display of vehicles on the different levels of the tower 102, such as 4 vehicles per level. The tower 102 may include multiple levels, such as 5 to 8, or more than 8 levels. The tower 102 may be a metallic structure with foundation and roof, vehicle pallets, and a central pick up lift-able shuttle 112. The lift-able shuttle 112 combines the functionalities of lifting, turning and moving of the platforms. The lift-able shuttle 112 may be located in the center of the tower 102 structure among the 4 main stays and has lifting and rotating movements. The vertical movement of the lift-able shuttle 112 may be driven by motors (e.g., 4 motors) integrated into the main columns directly under the roof and counterweights of the lifting system.

In various embodiments, each delivery bay 106*a*-106*d* may include an interior door 132*a*-132*d* positioned between the delivery bay and the corridor 104 as well as an exterior door 134*a*-134*d* positioned between the delivery bay and an exterior of the vehicle vending machine 100. In some embodiments, each interior door 132*a*-132*d* may only be opened when the corresponding exterior door 134*a*-134*d* is closed and each exterior door 134*a*-134*d* may only be opened when the corresponding interior door 132*a*-132*d* is closed.

Various vehicles 144*a*-144*e* and various vehicle pallets 142*a*-142*e* are illustrated in FIG. 1A. In various embodiments, vehicles 144*a*-144*e* are positioned on vehicle pallets 142*a*-142*e* within the vehicle vending machine 100. For example, FIG. 1A illustrates robotic carrier 114 carrying vehicle 144*c* positioned on vehicle pallet 142*c*. In various embodiments, the vehicle pallets 142*a*-142*e* may be closed metallic structures. The surfaces of the pallets 142*a*-142*e* may have an anti-skid coating. The pallets may be fitted with any type vehicle. A slight elevation in the middle of the pallets 142*a*-142*e* may act as a wheel deflector for positioning the car better. Wheels may ensure the sliding of the pallet and eyelets may be the hooking points for a pallet carrier.

In one embodiment, robotic carrier 114 may navigate corridor 104 while carrying vehicle 144*c* positioned on vehicle pallet 142*c*. The robotic carrier 114 may operate as an automated delivery system (ADS) to deliver vehicles from the tower 102 to the bays 106*a*-*d*. In this embodiment, robotic carrier 114 may deliver vehicle 144*c* positioned on vehicle pallet 142*c* to delivery bay 106*c* for delivery to a customer. In some embodiments, the robotic carrier 114 may traverse the corridor 104 independently by driving down the corridor 104 and aligning itself using its wheels within the corridor 104. In other embodiments, an optional track 170 or rail system may be included in the corridor 104 to guide the robotic carrier 114 through the corridor 104. The robotic carrier 114 may use a conductor line system for the transmission of power and data. A contact line may be installed in the floor of the corridor 104 to indicate that bays 106*a-d* and that will supply the robotic carrier 114 with electric power. On the same line data for the robotic carrier 114 to transport he pallets to the necessary bays. May be provided. The position of the robotic carrier 114 may be continuously monitored by a laser sensor placed underneath the robotic carrier 114. This laser sensor may read head moves along a bar code tape and the processor may calculate the absolute position data in the direction of travel with millimeter accuracy. This accuracy is possible because the laser scans simultaneously 3 bar codes and has flexible read distances which makes possible to bridge mechanical deviations. The labeling system allows the robotic carrier 114 to continue operation after an interruption (e.g. voltage drop or emergency stop) without needing to use a reference point. The communication with the robotic carrier 114 may be via wireless or wired communication, such as via WLAN (e.g., Wi-Fi, etc.) to a WLAN access point on the robotic carrier 114.

As shown in FIG. 1A, vehicle 144*a* positioned on vehicle pallet 142*a* may be located in delivery bay 106*a* for delivery to a customer and vehicle 144*d* positioned on vehicle pallet 142*d* may be located in delivery bay 106*d* for delivery to another customer. In addition, vehicle 144*e* positioned on vehicle pallet 142*e* may be located in a storage slot of the tower 102. In various embodiments, robotic carrier 114 may be configured to retrieve an empty pallet, such as vehicle pallet 142*b*, from a delivery bay, such as delivery bay 106*b*, and return the empty pallet to the tower 102. In various embodiments, a customer may decline or otherwise decide not to take delivery of a vehicle, in which case the robotic carrier 114 may be configured to retrieve the vehicle positioned on a vehicle pallet from the delivery bay (e.g., vehicle 144*d* positioned on vehicle pallet 142*d* in delivery bay 106*d*).

Figure 1B:
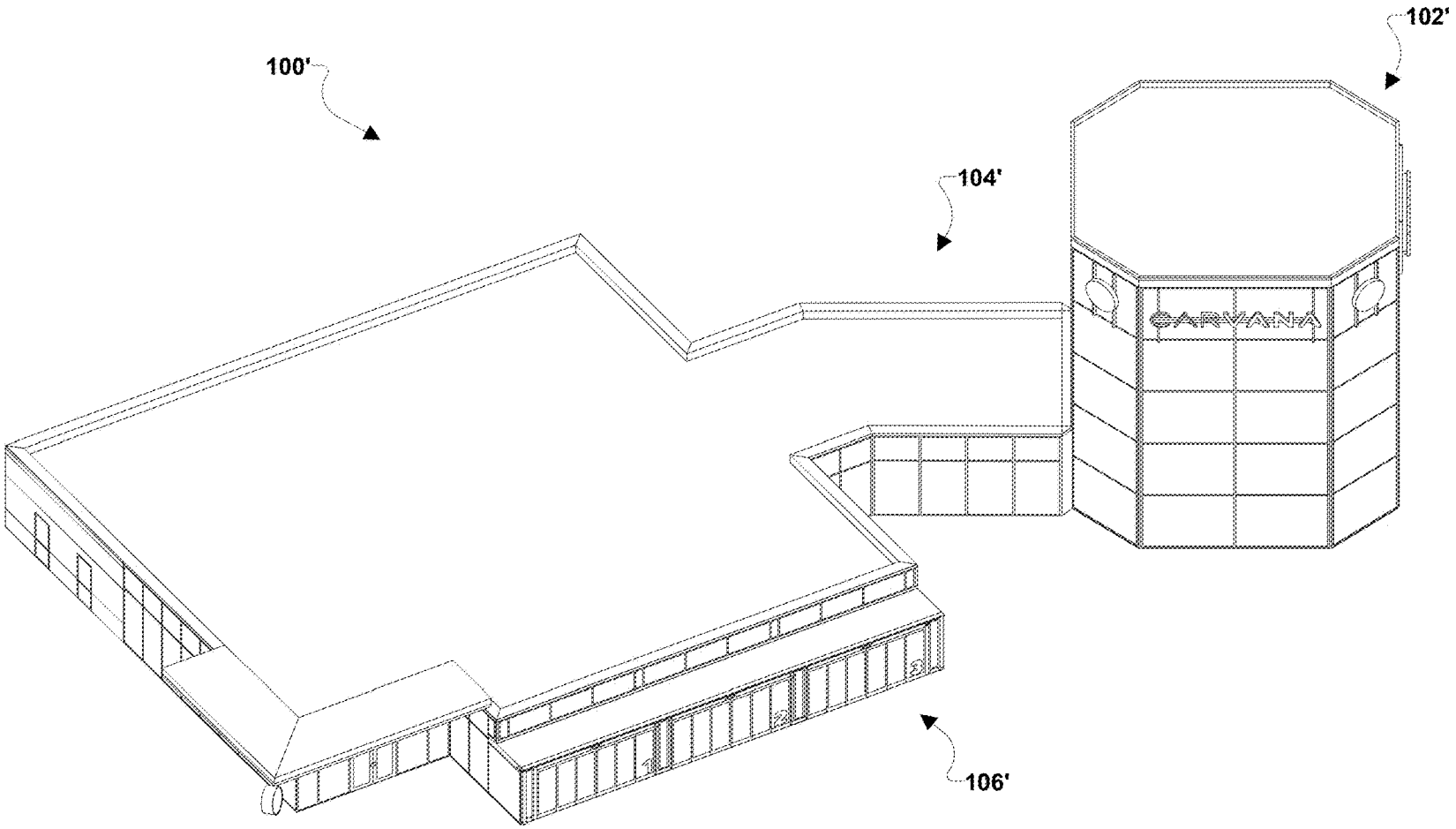
FIG. 1B illustrates an outside view of an example vehicle vending machine according to various embodiments.

FIG. 1B illustrates an outside view of an example vehicle vending machine 100' according to various embodiments. Vehicle vending machine 100' may be similar to vehicle vending machine 100 described above and below; and in a similar manner vehicle vending machine 100' may also include a tower 102', a corridor 104', and a plurality of delivery bays 106' as well as other devices and systems described herein.

Figure 2A:
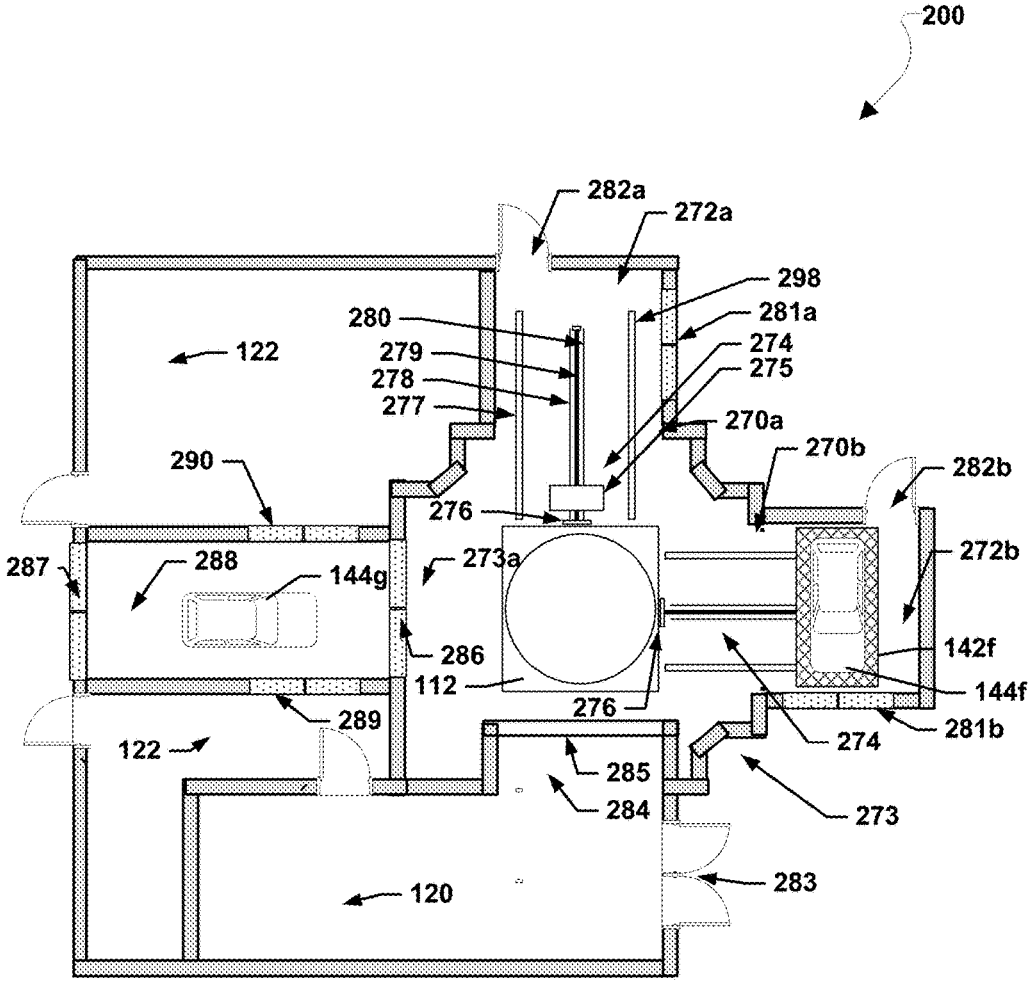
FIG. 2A is a block diagram of an example of a vehicle vending machine according to various embodiments.
Figure 2B:
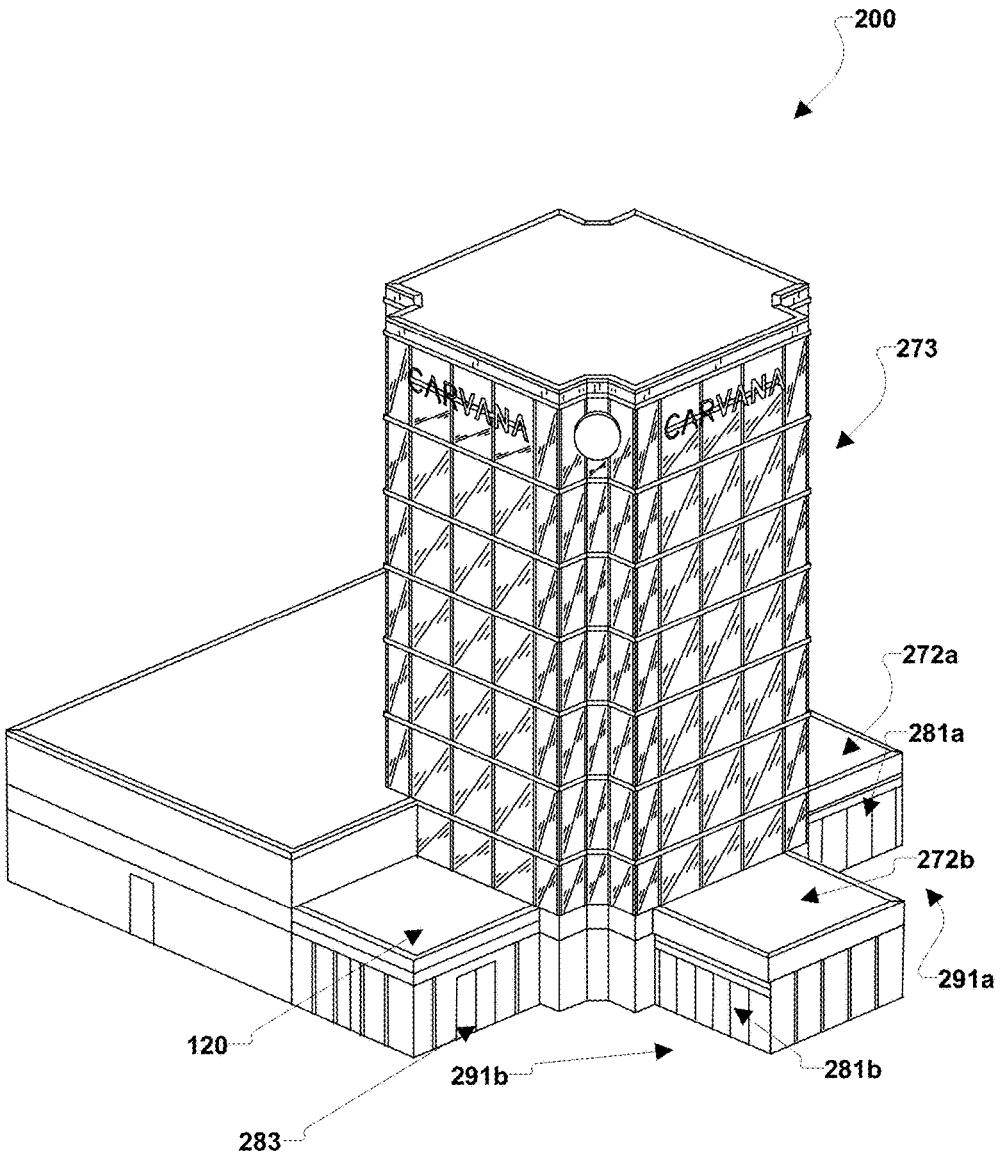
FIG. 2B illustrates an outside view of an example vehicle vending machine according to various embodiments.
Figure 2C:
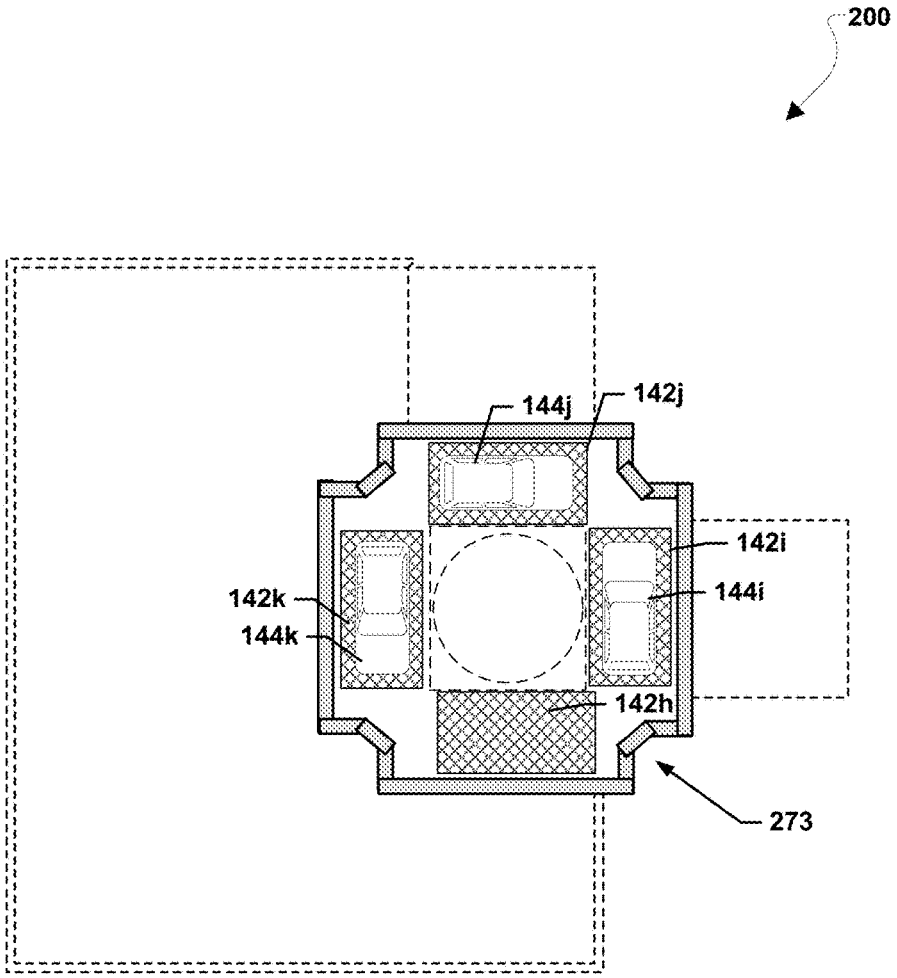
FIG. 2C is a block diagram of a vertically offset upper floor of an example vehicle vending machine according to various embodiments.

FIG. 2A illustrates an example of a vehicle vending machine 200 according to various embodiments. FIG. 2A is a ground floor cut-away view of the vehicle vending machine 200 illustrating the inside of the vehicle vending machine 200. FIG. 2B illustrates an outside view of the vehicle vending machine 200. FIG. 2C is an upper floor cut-away view of inside of the vehicle vending machine 200, specifically showing storage locations in the tower 273 of the vehicle vending machine that are on a different vertical level than the ground floor illustrated in FIG. 2A.

With reference to FIGS. 1-2C, the vehicle vending machine 200 may be similar to vehicle vending machines 100 and 100' described above and below and may include many of the same devices and systems described therein. Vehicle vending machine 200 may differ from vehicle vending machines 100 and 100' in that the vehicle vending machine 200 may include a corridor 270*a* and 270*b* associated with each delivery bay 272*a* and 272*b* such that, in vehicle vending machine 200, a vehicle may laterally traverse from the tower 273 to the delivery bay 272*a* or 272*b*. In various embodiments, the vehicle vending machine 200 may be configured such that the vehicles from the tower 273 transit from the tower 273 into a selected delivery bay 272*a* or 272*b* along a direction perpendicular to the forward driving direction of the vehicle. Put another way, the vehicle vending machine 200 may be configured to deliver the vehicles from the tower 273 sideways into a selected delivery bay 272*a* or 272*b*.

The vehicle vending machine 200 may include a tower 273, a plurality of delivery bays 272*a*-272*b*, and a plurality of corridors 270*a*-270*b*, each corridor 270*a*-270*b* connecting a respective one of the delivery bays 272*a*-272*b* to the tower 273. In various embodiments, the delivery bays 272*a* and 272*b* may be offset ninety degrees to one another relative to the tower 273 and lift-able shuttle 112. The lift-able shuttle 112 may be at the center of the tower 273. The vehicle vending machine 200 may include a lobby 120 and office 122 or other type areas, such as work areas, restrooms, machinery spaces, etc. One or more processors may be connected to the various motors, sensors, displays, cameras, and other equipment described herein that may be used in the vehicle vending machine 200 to control such equipment to perform the operations described herein. The tower 273 may provide for the storage and display of vehicles on the different levels of the tower 102, such as 4 vehicles per level. For example, FIG. 2C illustrates an upper level of the tower 273 that may be disposed vertically over the ground floor level of the tower 273 and overall vehicle vending machine 200 shown in FIG. 2A. The tower 273 may include multiple levels, such as 2 or more levels, such as 5 to 8 levels, or more than 8 levels. The upper level of the tower 273 illustrated in FIG. 2C may represent any of the upper levels of the tower 273 vertically arranged over the ground floor of the tower 273, such as the second, third, fourth, fifth, sixth, seventh, eighth, etc., levels. The tower 273 may be a metallic structure with foundation and roof, vehicle pallets, and a central pick up lift-able shuttle 112. The lift-able shuttle 112 combines the functionalities of lifting, turning and moving of the platforms. The lift-able shuttle 112 may be located in the center of the tower 273 structure among the 4 main stays and has lifting and rotating movements. The vertical movement of the lift-able shuttle 112 may be driven by motors (e.g., 4 motors) integrated into the main columns directly under the roof and counterweights of the lifting system.

In various embodiments, each delivery bay 272*a*-272*b* may be open to its respective corridor 270*a*-270*b* that connects to the tower 273. Each delivery bay 272*a*-272*b* may include an exterior door 281*a*-281*b*, respectively, that may be positioned between the delivery bay 272*a*-272*b* and an exterior of the vehicle vending machine 200. The delivery bay exterior doors 281*a*-281*b* may be configured to enable a vehicle to be driven from the delivery bay 272*a*-272*b* out of the vehicle vending machine 200 for delivery to a customer. Additionally, each delivery bay 272*a*-272*b* may include a personnel door 282*a*-282*b*, respectively, that may enable an employee to enter the respective delivery bay 272*a*-272*b* to drive a vehicle out of the delivery bay 272*a*-272*b* and vehicle vending machine 200 for delivery to a customer. In some embodiments, each delivery bay exterior doors 281*a*-281*b* and/or each personnel door 282*a*-282*b* may only be opened when a vehicle on a pallet has been delivered to the respective delivery bay 272*a*-272*b*. In various embodiments, after a pallet is secured in the respective delivery bay 272*a*-272*b*, the respective delivery bay exterior door 281*a*-281*b* (e.g., a sliding door) may be unlocked and opened automatically.

In various embodiments, a control system of the vehicle vending machine 200 may control the locking/unlocking and/or opening/closing of the delivery bay exterior doors 281*a*-281*b* and personnel doors 282*a*-282*b*. The control system may communicate the status of the delivery bay exterior doors 281*a*-281*b* and personnel doors 282*a*-282*b* to an employee via one or more control panel, such as a portable computing device used by the employee. The control panel may have a unique identifier, such as a service set identifier (SSID), that may be monitored by wireless by the control system of the vehicle vending machine 200 to enable opening or closing of the delivery bay exterior doors 281*a*-281*b* and/or personnel doors 282*a*-282*b*. Additionally, the control panel may enable an employee to open or close and/or lock or unlock the delivery bay exterior doors 281*a*-281*b* and/or personnel doors 282*a*-282*b*.

In various embodiments, a carrier, such as an automatic delivery system (ADS) 274, may be arranged in the corridors 270*a*-270*b* and delivery bays 272*a*-272*b*. Each corridor 270*a*-270*b* and delivery bay 272*a*-272*b* pair may have its own respective ADS 274. The ADS 274 may be a robotic carrier configured to traverse a vehicle on a pallet (or an empty pallet) from the lift-able shuttle 112 in the tower 273 through a respective corridor 270*a*-270*b* and into a respective delivery bay 272*a*-272*b*, as well as traverse empty pallets (or pallets with vehicles on them) from a respective delivery bay 272*a*-272*b* through a respective corridor 270*a*-270*b* and onto the lift-able shuttle 112 in the tower 273. The ADS 274, a type of robotic carrier, may include a delivery hitch 275 that may be a linear delivery system driven by a ball screw 279 and guided by two track roller guide rails 278 and 280. The delivery hitch 275 may be connected to the guide tracks 278, 280 via four profiled track rollers on a shaft, and two flat track rollers onto the top of the guide track channel. There may be a guide track 278, 280 on two sides of the delivery hitch 275, and a ball screw 279 that lies on the central axis of this carrier system. The delivery hitch 275 may have six track rollers. Two track rollers may be steel ball bearings with a flat outer bearing contact surface. Four track rollers may be steel ball bearings with a profiled outer bearing contact surface to provide the hitch 275 with lateral stability when paired with a shaft. The drive motor 276 of the ball screw 279 may have a built-in encoder, when paired with the pitch of the ball screw 279, that may provide constant knowledge of the position of the pallet on the carrier. The range of travel of the delivery hitch 275 may be programmed into the system to prevent over-travel. There may be a proximity switch that detects when a pallet is properly loaded onto the delivery hitch 275. Once the pallet is positioned onto the delivery hitch 275, it will depress a spring-loaded steel plate that will position in front of the proximity switch. This switch may then send the "OK" signal to the system to proceed with delivery operations.

In various embodiments, the floor in a delivery bay 272*a*-272*b* may be leveled with the outside floor in a delivery area outside the vehicle vending machine 200, such as a delivery area 291*a*-291*b*, respectively, outside the exterior doors 281*a*-281*b* of the delivery bays 272*a*-272*b*. The corridors 270*a*-270*b* connecting the tower 273 to the delivery bays 272*a*-272*b*, respectively, may be prepared with a recess which will allow for the top of the pallet to be flush with the floor of the delivery bays 272*a*-272*b*. Additionally, the recessed portion of the delivery bays 272*a*-272*b* floors may have a pit that lies along the centerline of the bays 272*a*-272*b* which may house portions of the robotic carrier (e.g., ADS 274 and its associated equipment). The corridors 270*a*-270*b* may be configured not to be transited by any customers or employees. Once the pallet is correctly placed onto the carrier (e.g., on delivery hitch 275), a signal may be sent to the control system via a proximity sensor to initiate the remaining sequence to move the pallet into the respective delivery bay 272*a*-272*b*. Once this sequence is initiated, the ball screw drive 279 may deliver the pallet down the corridor into the respective delivery bay 272*a*-272*b* into a "final position" which may be indicated by an embedded encoder inside of the ball screw drive motor 276. After the vehicle is driven off the pallet out of the respective delivery bay 272*a*-272*b*, the respective delivery bay exterior door 281*a*-281*b* (e.g., a sliding door) may close and the ADS 274 may reverse the delivery process to return the empty pallet to the tower 273 through the respective corridor 270*a*-270*b*. In some embodiments, the pallet may be empty because the vehicle was driven out of the delivery bay exterior door 281*a*, 281*b* to show to a customer. The delivery bay exterior door 281*a*, 281*b* may close after the vehicle exits the delivery bay 272*a*, 272*b*, thereby preventing the vehicle from being returned to the pallet. Should the customer accept delivery of the vehicle, the vehicle may be possessed by the customer. Should the customer decline delivery of the vehicle, the vehicle may be driven by the employee around the vehicle vending machine 200 to the exterior door 287 for return to the tower 273 through the vehicle preparation area 288 and tower loading door 286. In this manner, vehicles may not be reloaded onto pallets in the respective delivery bays 272*a*, 272*b*.

In some embodiments, the vehicle vending machine 200 may include a tower loading door 286 internal to the vehicle vending machine 200 that may connect to a vehicle preparation area 288. The vehicle preparation area 288 may be disposed between the tower loading door 286 and an external door 287 of the vehicle vending machine 200. The vehicle preparation area 288 may be an area in which vehicles may be inspected and prepared prior to loading into the tower 273. The external door 287 may be opened to enable vehicles to be driven into the vehicle preparation area 288 from outside the vehicle vending machine 200 and/or from the vehicle preparation area 288 out of the vehicle vending machine 200. The vehicle preparation area 288 may include doors that do not lead to the tower 273 as well, such as doors 289-290 that may enable employees to enter/exit the vehicle preparation area 288 from/to the offices 122, lobby 120, and or other internal spaces of the vehicle vending machine 200 other than the tower 273. The tower loading door 286 may be an automatic door controlled to remain closed while the tower 273 is in operation. Once a vehicle is ready in the vehicle preparation area 288, the tower loading door 286 may be opened and the vehicle may be driven from the vehicle preparation 288 area through the tower loading door 286 and through a loading area 273*a* of the tower 273 onto a vehicle pallet on the lift-able shuttle 112. In the loading area 273*a* of the tower 273 may be a hydraulic powered lift gate that bridges the gap between the tower loading door 286 and a vehicle pallet. This vehicle pallet may be attached to the lift-able shuttle 112 in an atrium at the center of the tower 273.

The vehicle vending machine 200 may also include a customer viewing area 284 connected to the lobby 120 that may include a glass wall 285 (or otherwise transparent wall, such as a windowed wall, etc.) that provides a view of the operations of the tower 273. The customer viewing area 284 may not allow customers access to the tower 273 machinery. The customer viewing area 284 may include various additional elements, such as a customer interaction kiosk, a virtual reality station, cameras, lights, etc.

In FIGS. 2A-2C, various vehicles 144*f*, 144*g*, 144*i*, 144*j*, and 144*k* are shown in various places throughout the vehicle vending machine 200. For example, FIG. 2A illustrates vehicle 144*g* in the vehicle preparation area 288 and vehicle

144*f* on a vehicle pallet 142*f* delivered by the ADS 274 from the lift-able shuttle 112 of the tower 273 through the corridor 270*b* and into a final position in delivery bay 272*b*. Additionally, vehicles 144*i*, 144*j*, and 144*k* are shown on vehicle pallets 142*i*, 142*j*, and 142*k* in FIG. 2C stowed in stowage locations in the upper level of the tower 273. Additionally, empty vehicle pallet 142*h* is shown stowed in the upper level of the tower 273. In the tower 273, the vehicles may be placed on top of pallets. The lifting mechanism of the tower 273 may bring the vehicles on the pallet to the ground level. The vehicle and pallet may be automatically transitioned from the turntable of the shuttle 112 to delivery hitch 275 by the shuttle 112 itself, and the delivery hitch 275 and ball screw 279 may move the vehicle and pallet transversally along the tracks and roller guides (e.g., 277, 278, 280, 298) into a selected delivery bay 272*a*-272*b*. The vehicle pallets 142*f*, 142*h*, 142*i*, 142*j*, and 142*k* are similar to vehicle pallets previously discussed herein, such as vehicle pallets 142*a*-144*e* and may be closed metallic structures with an anti-skid coating surface. The pallets may be fitted with any type vehicle. A slight elevation in the middle of the pallets may act as a wheel deflector for positioning the vehicle better. Wheels on the underside of the pallet may ensure the sliding of the pallet and eyelets may be the hooking points for a pallet carrier. For example, wheels on the underside of the vehicle pallets may be arranged perpendicular to the storage direction of a vehicle on the pallet and may slide along rails or tracks in the lift-able shuttle 112, rails or tracks in the storage locations in the tower 273, and/or rails or tracks in the corridors 270*a*-270*b* and delivery bays 272*a*-272*b* (such as rails or tracks 277 and 298) to enable to pallets to be moved laterally throughout the tower 273, the corridors 270*a*-270*b*, and/or the delivery bays 272*a*-272*b*. As such, vehicles on vehicle pallets may move laterally (i.e., side-to-side) in the vehicle vending machine 200 relative to the normal forward/reverse driving direction of the vehicles that the vehicles may move when entering/exiting the vehicle vending machine 200 (e.g., through external door 287), driving onto/off of the lift-able shuttle 112 (i.e., to be placed on or removed from a pallet on the shuttle 112), or driving out of the deliver bays 272*a*-272*b* through the external bay doors 281*a*-281*b*. In various embodiments, a customer may decline or otherwise decide not to take delivery of a vehicle, in which case the ADS 274 may be configured to retrieve the vehicle positioned on a vehicle pallet from the appropriate delivery bay 272*a*-272*b* and return it to the tower 273 and lift-able shuttle 112.

Figure 3A:
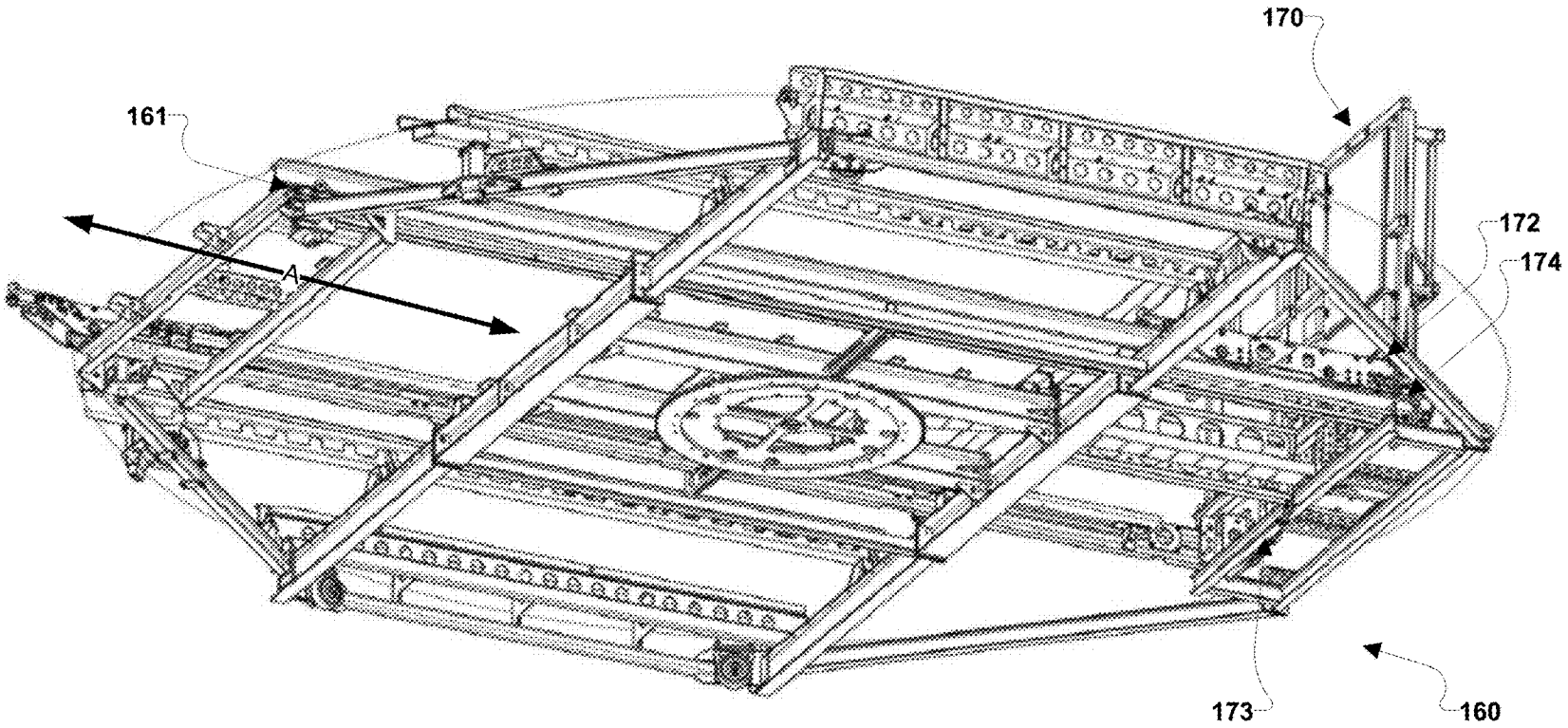
FIG. 3A is a block diagram of the underside of an example vehicle turntable according to various embodiments.
Figure 3B:
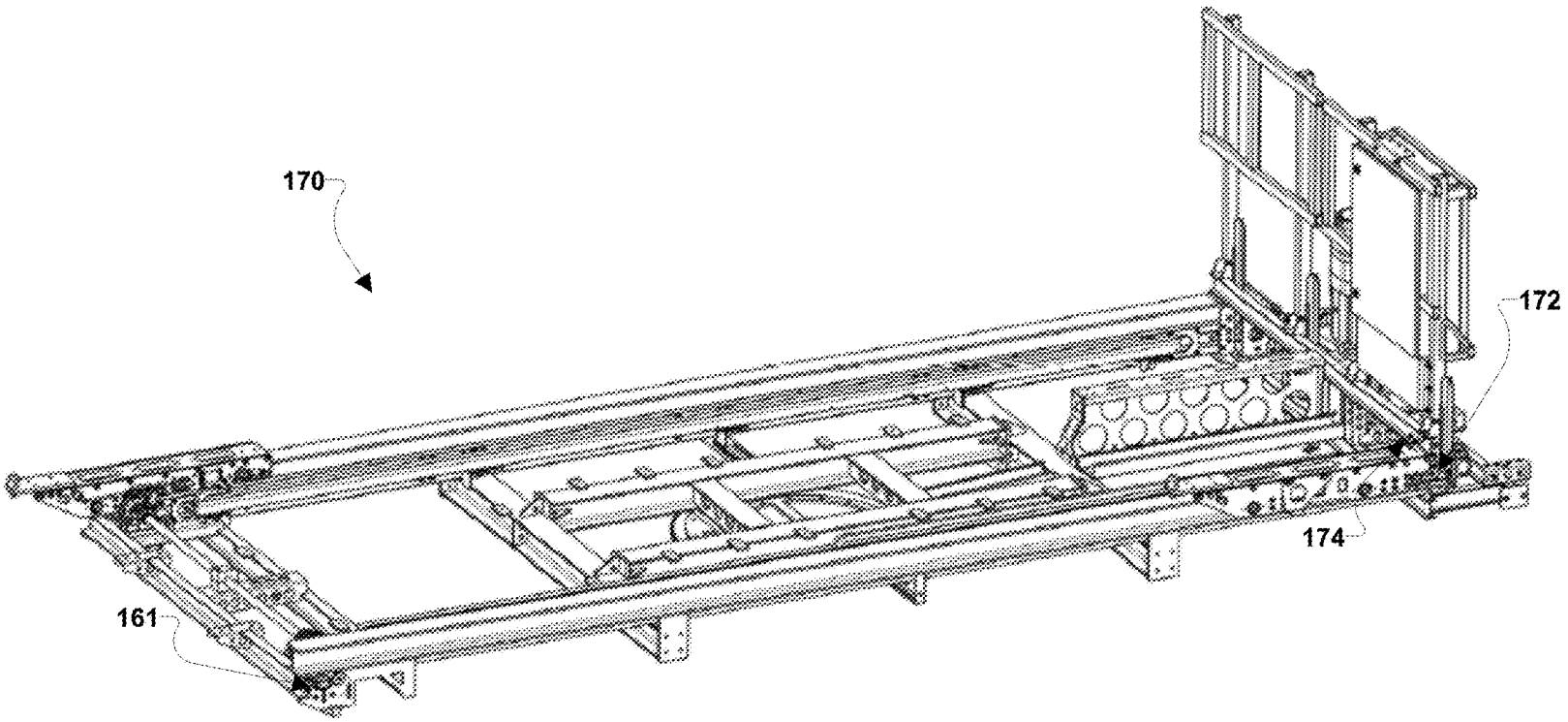
FIG. 3B is a block diagram of an example pallet carrier according to various embodiments.
Figure 3C:
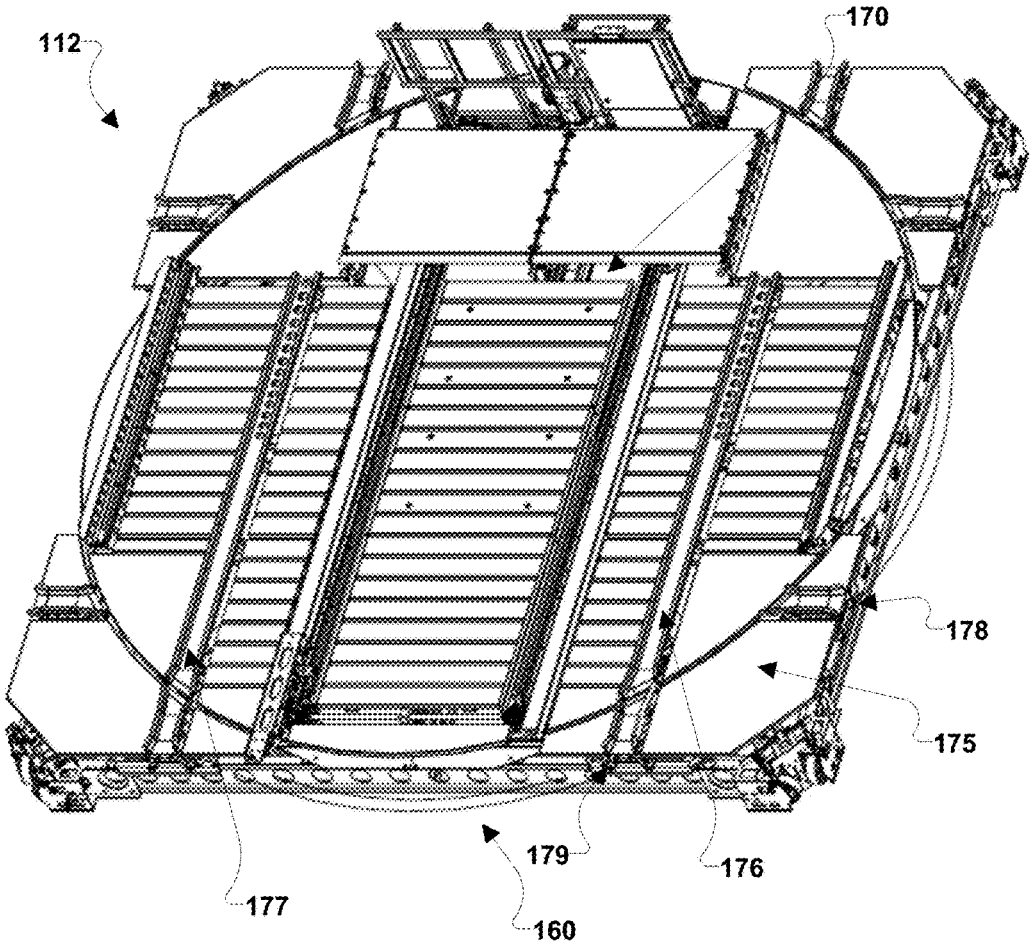
FIG. 3C is a block diagram of an example vehicle turntable according to various embodiments.
Figure 3D:
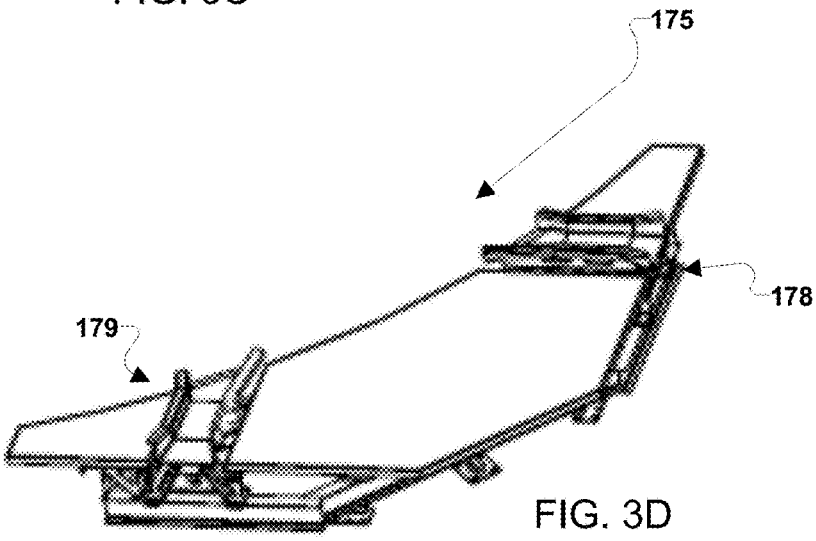
FIG. 3D is a block diagram of a portion of the example vehicle turntable of FIG. 3C.

FIG. 3A illustrates the underside of an example vehicle turntable 170 according to various embodiments. The turntable 160 may be a portion of the lift-able shuttle 112 within the tower (e.g., tower 102, 102', 273, etc.). As a vehicle, such as vehicle is driven onto the lift-able shuttle 112, the turntable 160 may enable the vehicle and its vehicle pallet to be rotated to align with the storage areas in the tower (e.g., tower 102, 102', 273, etc.). The pallet carrier 170 may be a portion of the turntable 160 and may support the vehicle pallet on the lift-able shuttle 112 and turntable 160. The turntable 160 may provide stability and guides the shuttle 112 up and down the mainstays while the pallet-carrier 170 that telescopes may pick up the car pallets from their parking position. FIG. 3B illustrates the pallet carrier 170 in more detail. The pallet carrier 170 and turntable 160 may rotate together around a central axis to align vehicles and their vehicle pallets for storage in the tower (e.g., tower 102, 102', 273, etc.), retrieval from the tower, and placement on a carrier (e.g., carrier 114, ADS 274, etc.). The pallet carrier 170 may extend in direction "A" out from and into the turntable 160 to move vehicle pallets onto and off of the lift-able shuttle 112. FIG. 3C illustrates the top of the fully assembled lift-able shuttle 112 showing the pallet carrier 170 within the turntable 160 with corner guides 175 installed. FIG. 3D illustrates a close up view of one corner guide 175. The turntable 160 may rotate to align rails or tracks 176 and 177 with rails or tracks 178 or 179 in the corner guides 175. The rails or tracks 176, 177, 178, and 179 may be configured to receive the wheels on the underside of the vehicle pallets and when aligned, those wheels may allow the vehicle pallet to be guided down the rails or tracks 176, 177, 178, and 179 onto and/or off of the lift-able shuttle 112. The rails or tracks 178, 179 on the corner guide 175 may align with rails or tracks of a carrier (such as rails or tracks 277 and 298 of ADS 274, etc.), pallet supports of a pallet carrier (such as pallet supports 308 of pallet carrier 252, etc.) As illustrated in FIGS. 3A and 3B, the pallet carrier 170 may include various sensors 161, 172, 173, and 174. The sensors 161, 172, 173, and 174 may be any type sensors, such as inductive sensors, limit switches, etc. The sensors 161, 172, 173, and 174 may enable the processor of the vehicle vending machine (e.g., vending machine 100, 200, etc.) to determine whether or not a vehicle pallet is positioned on the lift-able shuttle 112 and whether or not the pallet carrier 170 is fully or partially retracted or extended in direction "A". The turntable 160 of the lift-able shuttle 112 moves by means of a transmission chain operated by a central geared motor. This motor also has a frequency converter or drive that manages the speed and brake points according to the programmed parameters. The turning movement is important because it places the vehicle in the right position either to be stored when lifting, or to exit or enter the lift-able shuttle 112 when lowered.

The pallet carrier 170 picks up the vehicle pallet and places it on the lift-able shuttle 112. A further motor with frequency converter controls the speed of the sliding movement of the telescopic arms of the pallet carrier 170. The pallet carrier 170 has as a back-up system of two roller-lever operated limit switches, one at each end. These sensors may monitor an improbable wrong movement of the telescopic arms (e.g. over passing the delivery position). The telescopic arm picks up the pallet by engaging the two eyelets of the car-pallet with two cylindrical pins. An inductive proximity sensor may monitor that the pallet is engaged. The lift unit for the lift-able shuttle may include four motors and variable frequency drives, 4 chains, and 4 counterweights dimensioned to carry the lift-able shuttle 112 and its weight up and down the tower (e.g., tower 102, 102', 273, etc.). The position and speed of the motors may be regulated by frequency inverters, each motor having a frequency inverter. The speed may be programmable; for instance, the lift-able shuttle 112 may be slowed down short before reaching the end position. The program may also monitor and compare the signals given by each frequency converter to ensure they are synchronized and the lift-able shuttle 112 is level.

In various embodiments, the operations of the vehicle vending machine (e.g., vending machine 100, 200, etc.) may be controlled by control panels, such as one or more control panels in the lobby 102 and/or offices 122. Additionally, the control panels may be portable. The control panels may be computing devices including processors configured to communicate with one or more processors of the vehicle vending machine controlling the various devices and systems within the vehicle vending machine. The control panels may be used to enable customers to select their vehicle and pick that vehicle up and by employees to perform various functions within the vehicle vending machine (e.g., vending machine 100, 200, etc.). For example, the control panels may enable customers and/or employees to initiate retrieval of a particular vehicle from the tower (e.g., tower 102, 102', 273, etc.), initiate the opening or closing of the front gates to the bays 106*a-d*, and initiate the retrieval and/or delivery of pallets by the robotic carrier 114.

Figure 4A:
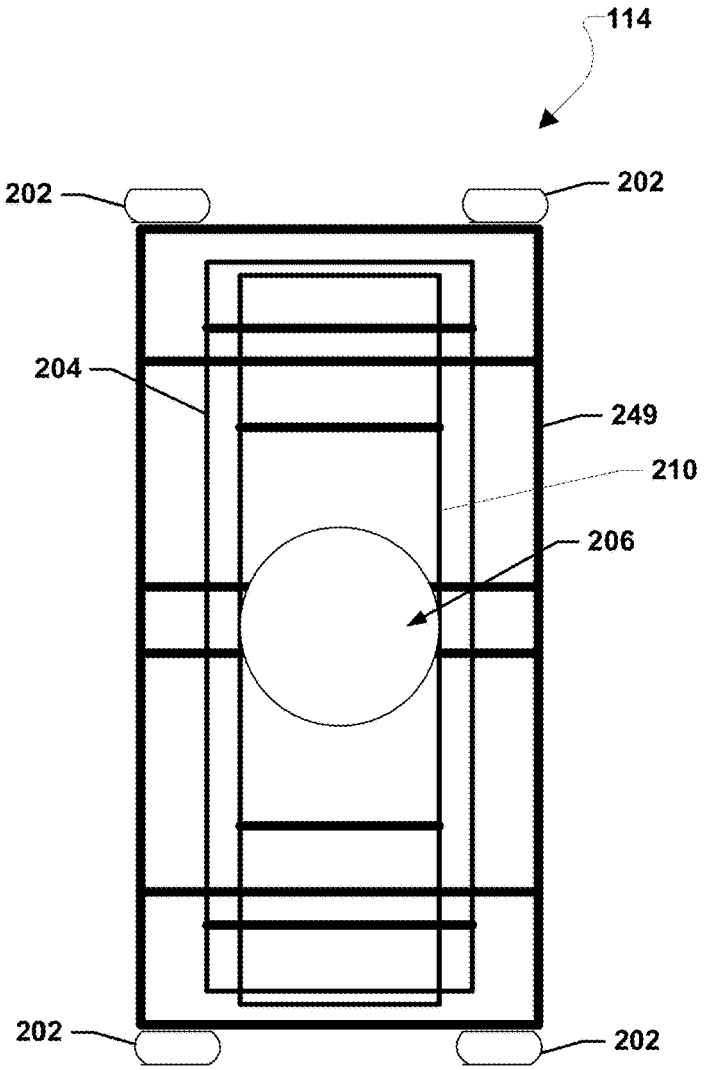
FIGS. 4A-4E are block diagrams of an example of a robotic carrier for use in a vehicle vending machine, according to various embodiments.
Figure 4B:
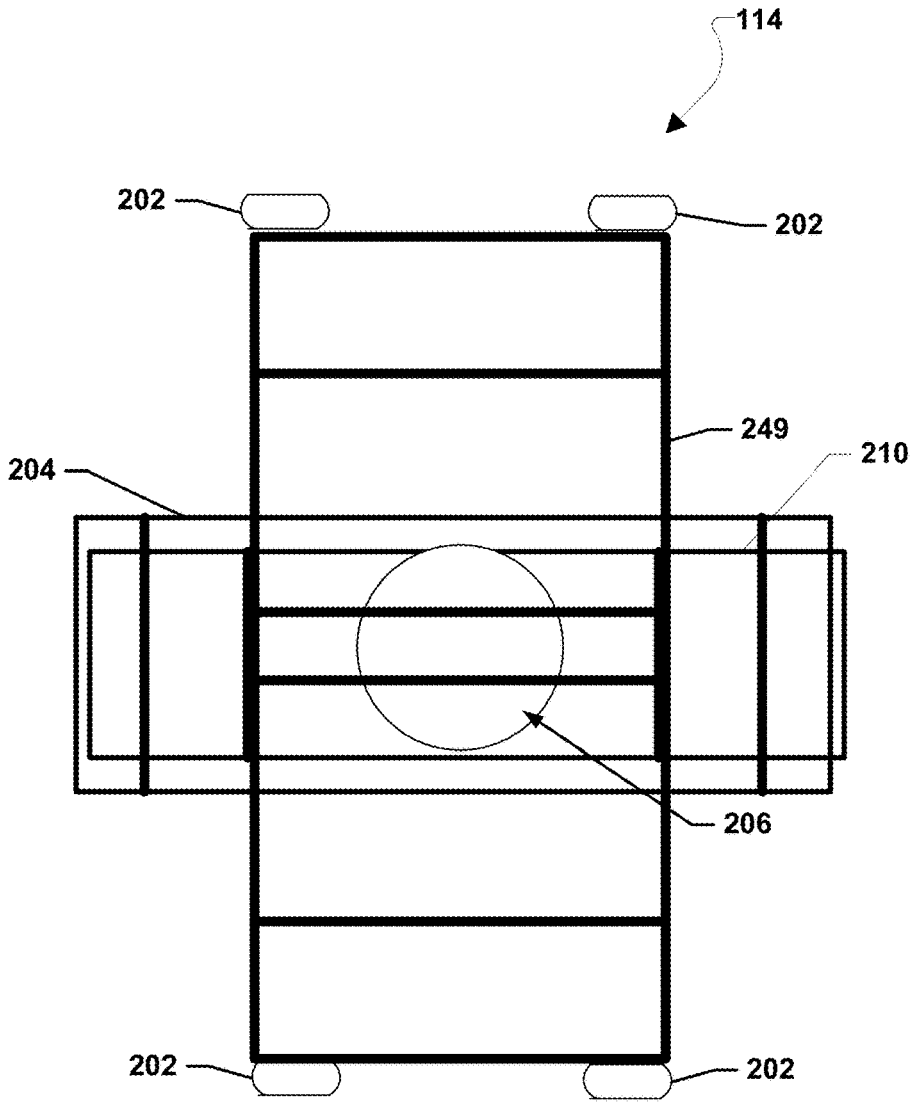
Figure 4C:
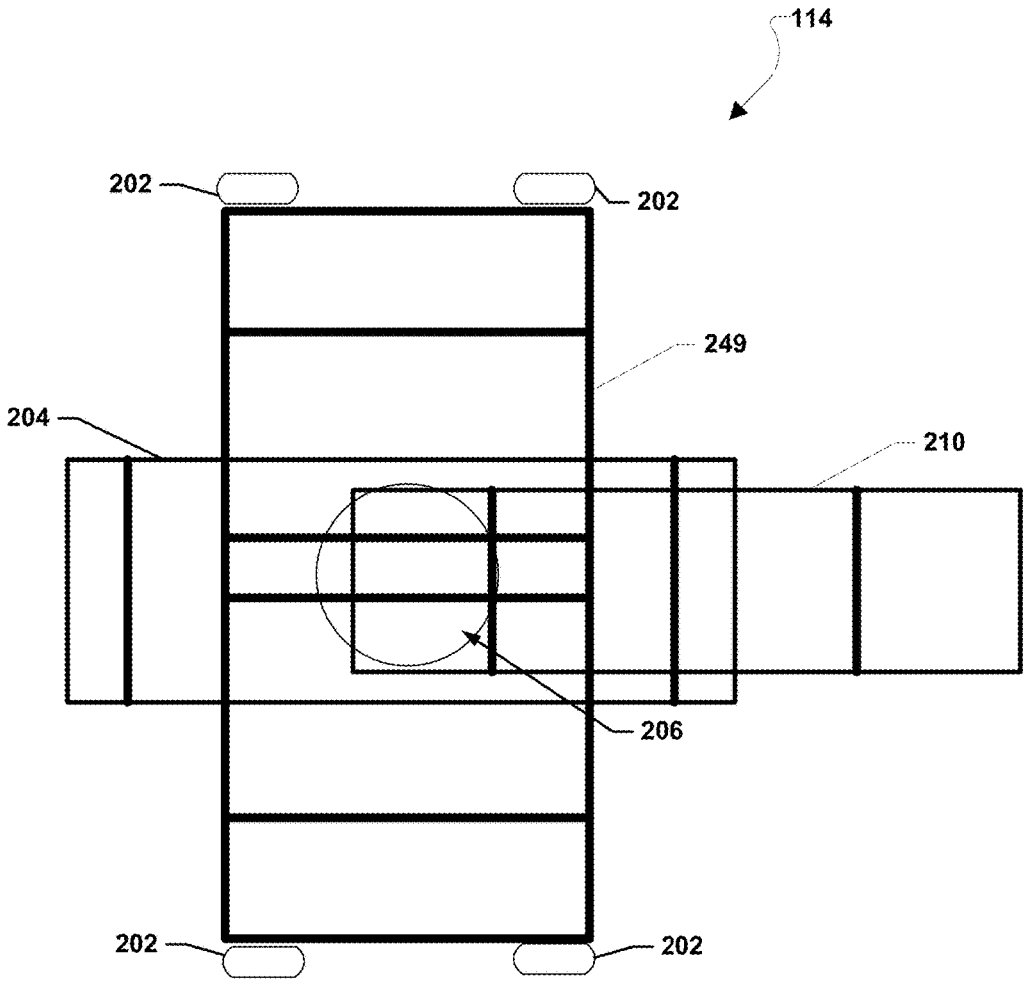
Figure 4D:
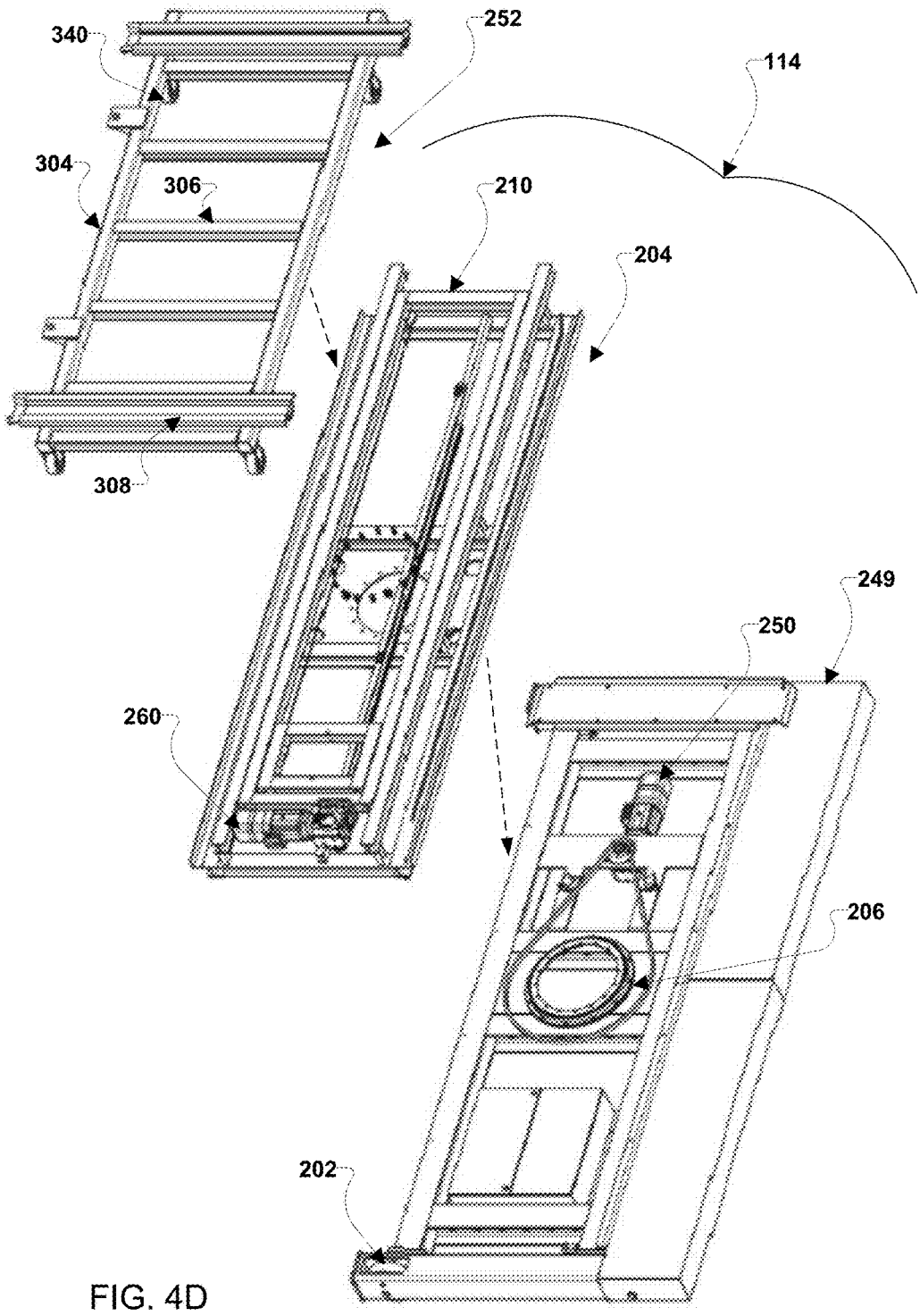
Figure 4E:
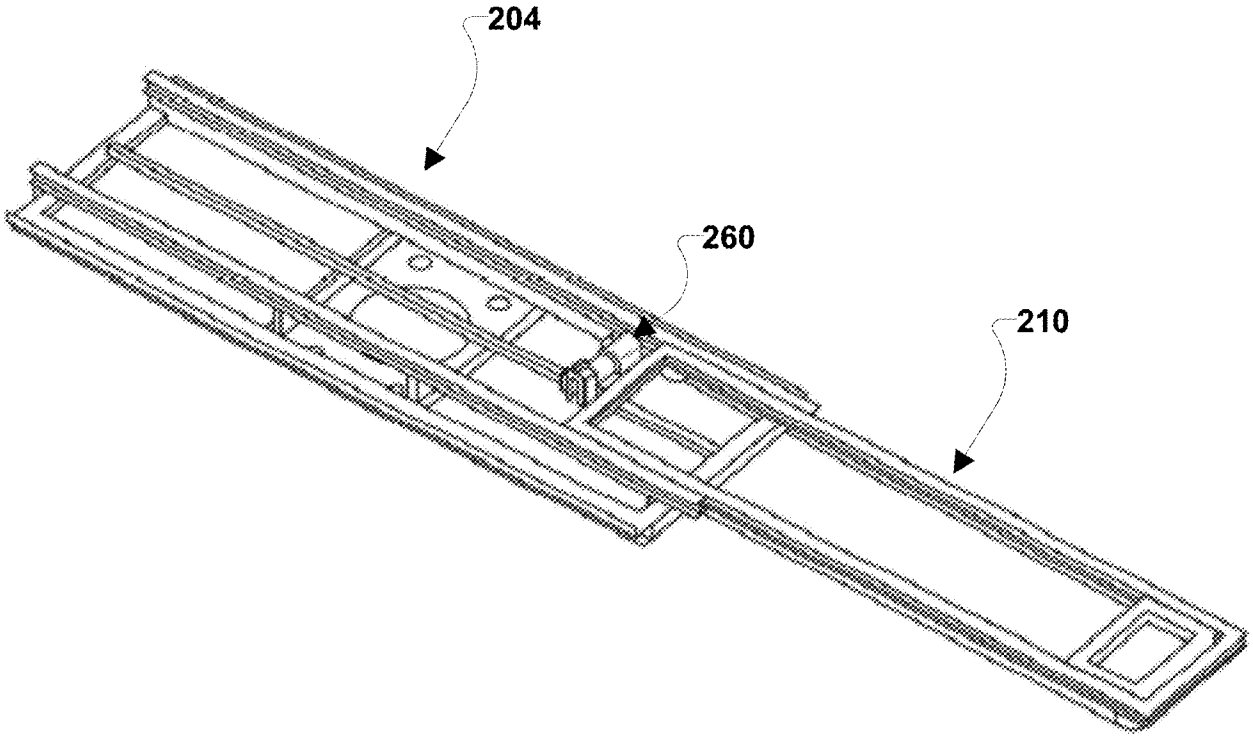

FIGS. 4A-4E illustrate various examples of a robotic carrier 114 for carrying a vehicle positioned on a vehicle pallet while navigating a corridor of a vehicle vending machine. The robotic carrier 114 may include a telescopic device 204 including a telescopic guide arm 210, and a gear or other rotation mechanism 206. In various embodiments, robotic carrier 114 may include wheels 202. In some embodiments, the wheels 202 may move along tracks 170 or rails by which the robotic carrier 114 may traverse an area of the vehicle vending machine. In other embodiments, the robotic carrier 114 may drive independent of tracks 170 or rails from one area to another. FIG. 4A illustrates the robotic carrier 114 fully collapsed or otherwise contained within a single space. FIG. 4B illustrates the robotic carrier 114 with the telescopic device 204 rotated at a 90° angle from the robotic carrier 114. FIG. 4C illustrates the robotic carrier 114 with the telescopic device 204 rotated at a 90° angle from the robotic carrier 114 and extended from the robotic carrier 114. FIG. 4D is an exploded diagram of the robotic carrier 114 and a pallet carrier 252 for carrying a vehicle pallet, such as vehicle pallets 142*a-e* described above. The pallet carrier 252 may be pulled onto the robotic carrier 114 by the telescopic guide arm 210 of the telescopic device 204 which may itself rest on top of the base 249 of the robotic carrier 114. The base 249 of the robotic carrier 114 may include the rotation mechanism 206 driven by a motor 250 that may rotate the telescopic device 204, telescopic guide arm 210, the pallet carrier 252, and any vehicle pallet thereon. A motor 260 on the telescopic device 204 may extend and retract the telescopic guide arm 210. Pallet carrier 252 may include an outer frame 304 and one or more cross-bars 306. Pallet carrier 252 may also include one or more pallet supports 308 and wheels 340. The pallet carrier 252 may include any number of wheels, such as two, four, or more wheels. FIG. 4E illustrates the telescopic device 204 with the telescopic guide arm 210 extended.

Figure 5:
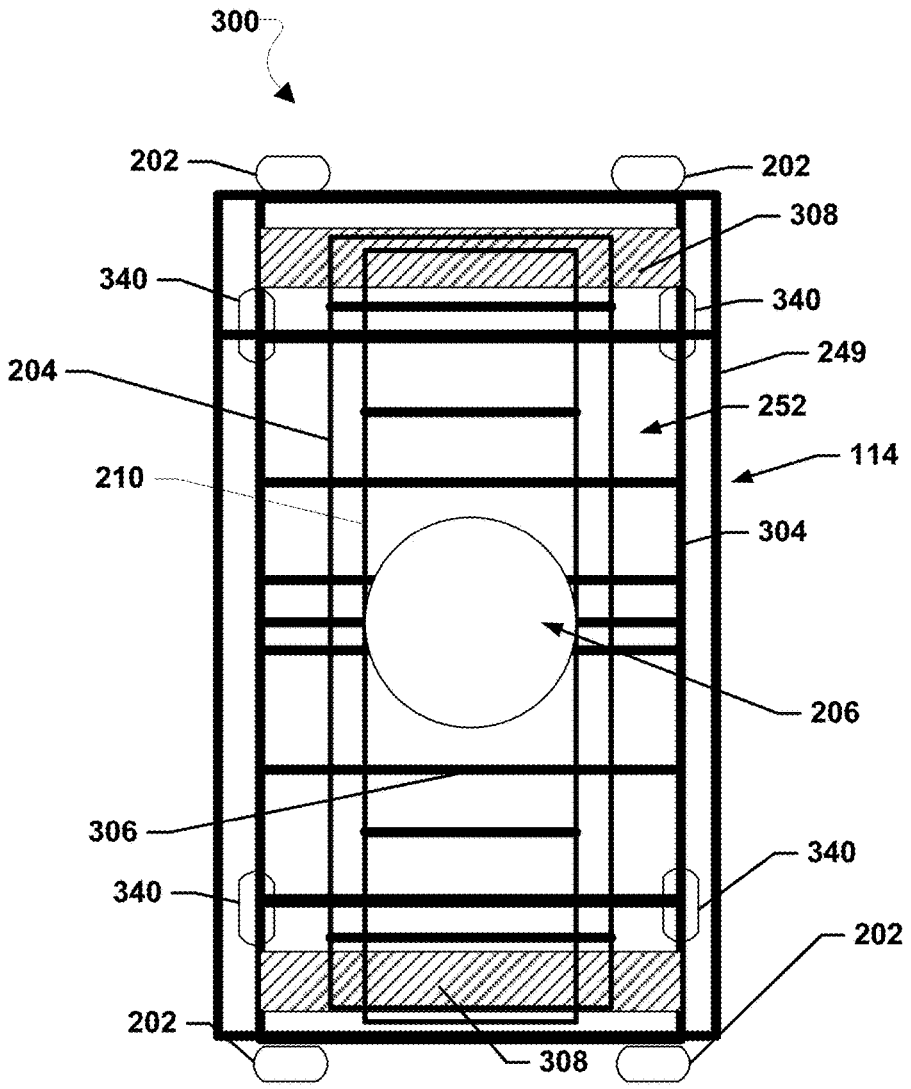
FIG. 5 is a block diagram of an example of a pallet carrier for use in a vehicle vending machine, according to various embodiments.

FIG. 5 illustrates an example of a system 300 for carrying a vehicle pallet on a robotic carrier, according to various embodiments. In some embodiments, the system 300 may include a pallet carrier 252 and robotic carrier 114 for carrying a vehicle pallet. In various embodiments, the pallet carrier 252 may be positioned on a robotic carrier, such as robotic carrier 114. In other embodiments, the pallet carrier 252 may be positioned or otherwise located in a location other than a robotic carrier. As such, pallet carrier 252 may be configured to be loaded onto and unloaded from the robotic carrier 114. In FIG. 5, the pallet carrier 252 is shown on the telescopic device 204.

Figure 6A:
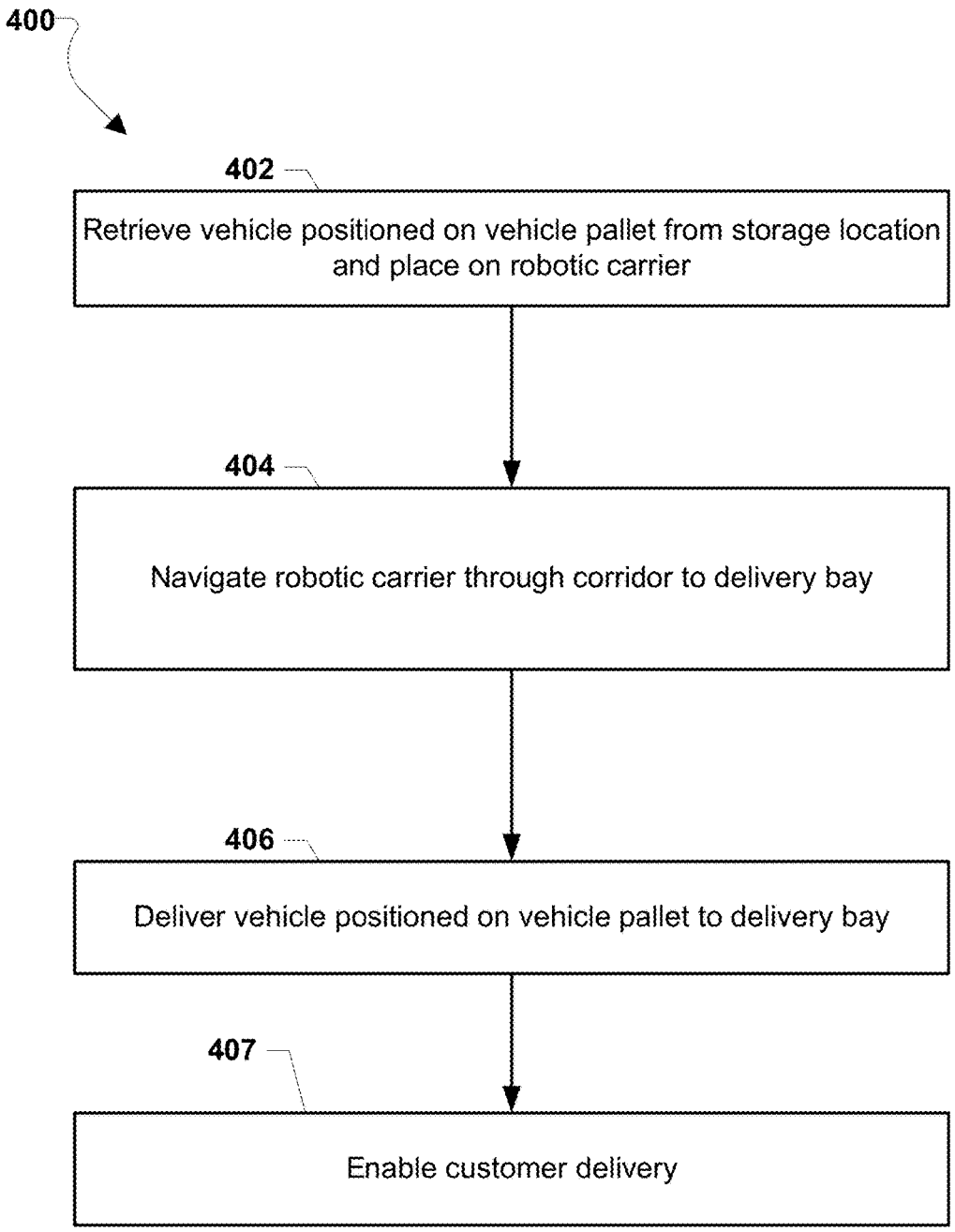
FIGS. 6A-6D are process flow diagrams illustrating examples of methods for operating a vehicle vending machine, according to various embodiments.

FIG. 6A illustrates a method 400 for operating a vehicle vending machine according to various embodiments. With reference to FIGS. 1A-6A, the operations of the method 400 may be performed by one or more processors of a vehicle vending machine (e.g., vehicle vending machine (e.g., vending machine 100, 200, etc.)). The vehicle vending machine may have sensors, cameras, and communication resources that may be used for retrieving a vehicle, navigating a corridor, and delivering a vehicle to a delivery bay.

In block 402, a vehicle positioned on a vehicle pallet may be retrieved from a storage location within a tower of a vehicle vending machine and placed on a robotic carrier. For example, if the vehicle is stored in a storage location on the fourth floor of the tower, a lift-able shuttle may be lifted to the fourth floor, the vehicle positioned on the vehicle pallet may be placed onto the lift-able shuttle, and the lift-able shuttle may be lowered to the level of a corridor of the vehicle vending machine. Once lowered, the vehicle positioned on a vehicle pallet may be placed on a robotic carrier. In various embodiments, the robotic carrier may be a delivery hitch that may a linear delivery system driven by a ball screw and guided by two track roller guide rails. This carrier that is the delivery hitch may connect the tower to the delivery bay through the corridor.

In block 404, the robotic carrier may navigate through a corridor to an appropriate delivery bay. In various embodiments, the robotic carrier may use a laser, a camera, and/or other sensors to monitor a position of the robotic carrier and traverse a path through the corridor. In some embodiments, the robotic carrier may include wheels that propel the robotic carrier along a floor of the corridor. In other embodiments, the corridor may include one or more tracks 170 or rails and the robotic carrier may be configured to follow the one or more tracks 170 or rails through the corridor. In some embodiments, the robotic carrier may be a delivery hitch that may a linear delivery system driven by a ball screw and guided by two track roller guide rails. The vehicle and pallet may be transitioned from the turntable of the shuttle to delivery hitch that may move the vehicle and pallet transversally along the track and roller guides into a selected delivery bay.

In block 406, the vehicle positioned on the vehicle pallet is delivered to a delivery bay. For example, upon arrival at an appropriate delivery bay, the robotic carrier may place the vehicle positioned on the vehicle pallet within the delivery bay. As another example, when the robotic carrier is a delivery hitch system, the drive motor of the ball screw may have a built-in encoder, when paired with the pitch of the ball screw, that may provide constant knowledge of the position of the pallet on the carrier. Once the pallet is correctly placed onto the carrier, a signal may be sent to the control system via a proximity sensor to initiate the remaining sequence to move the pallet into the delivery bay. Once this sequence is initiated, a ball screw drive may deliver the pallet down the corridor into the delivery bay into a "final position" which may be indicated by an embedded encoder inside of the ball screw drive motor.

In block 407, delivery to the customer of the vehicle in the delivery bay may be enabled. For example, one or more doors of the delivery bay may be opened to enable the vehicle to be driven off the vehicle pallet and out of the vehicle vending machine. Additionally, when the appropriate bay doors may already be open, the vehicle may be driven off the vehicle pallet by a customer and/or an employee.

Figure 6B:
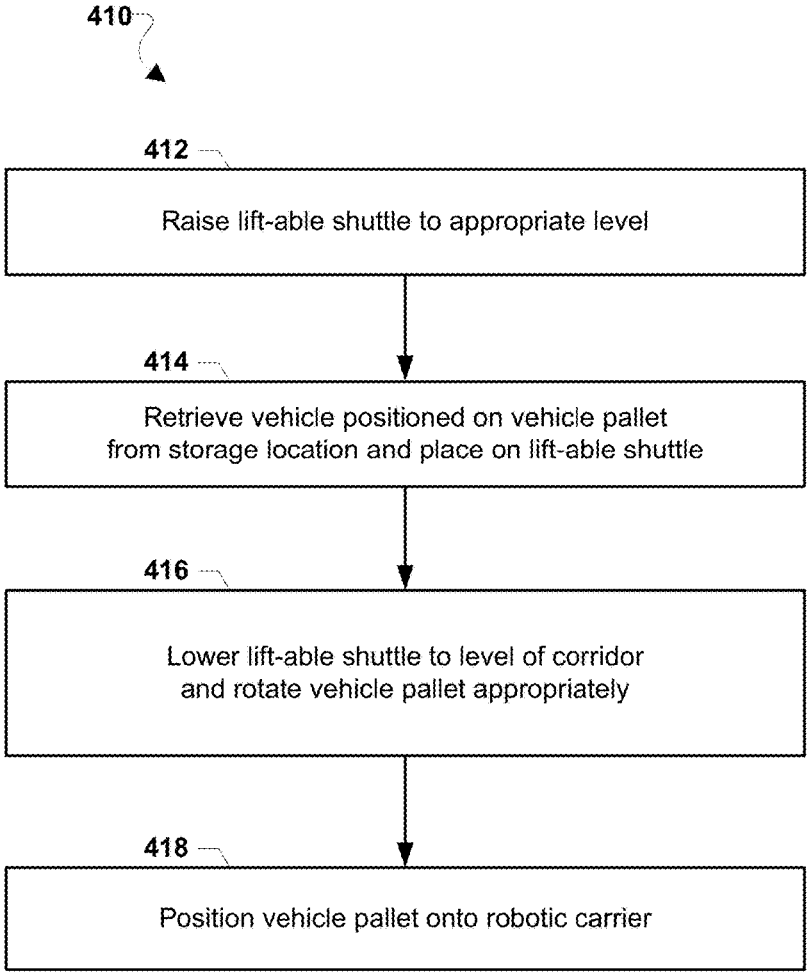

FIG. 6B illustrates a method 410 for retrieving a vehicle from a storage location within a tower of a vehicle vending machine. With reference to FIGS. 1A-6B, the method 410 provides examples of operations that may be performed in block 402 of the method 400. The operations of the method 410 may be performed by one or more processors of a vehicle vending machine (e.g., vehicle vending machine (e.g., vending machine 100, 200, etc.)).

In block 412, a lift-able shuttle within the tower of the vehicle vending machine may be raised to an appropriate level of the tower. For example, if the vehicle is stored on the third level, the lift-able shuttle would be raised to the third level. In block 414, the vehicle positioned on a vehicle pallet is retrieved from the storage location and placed on the lift-able shuttle.

In block 416, the lift-able shuttle is lowered to the level of the corridor and the vehicle pallet is rotated appropriately. For example, the vehicle may have been stored in a storage location such that the vehicle is positioned perpendicular to the corridor while the vehicle needs to be positioned parallel to the corridor in order to be transported by a robotic carrier. In this example, the vehicle pallet (and the vehicle positioned on the vehicle pallet) would be rotated from the perpendicular position to the parallel position. As another example, the vehicle pallet (and the vehicle positioned on the vehicle pallet) may be positioned to slide sideways through the corridor. Additionally, in some embodiments, more than one corridor may be connected to the tower. In such embodiments, the vehicle pallet (and the vehicle positioned on the vehicle pallet) may be oriented to align with the appropriate corridor along which the vehicle is to transit toward a selected delivery bay.

In block 418, the vehicle pallet is positioned onto the robotic carrier. For example, the vehicle pallet (and vehicle positioned on the vehicle pallet) may be moved or otherwise transferred from the lift-able shuttle to the robotic carrier via an opening in the tower.

Figure 6C:
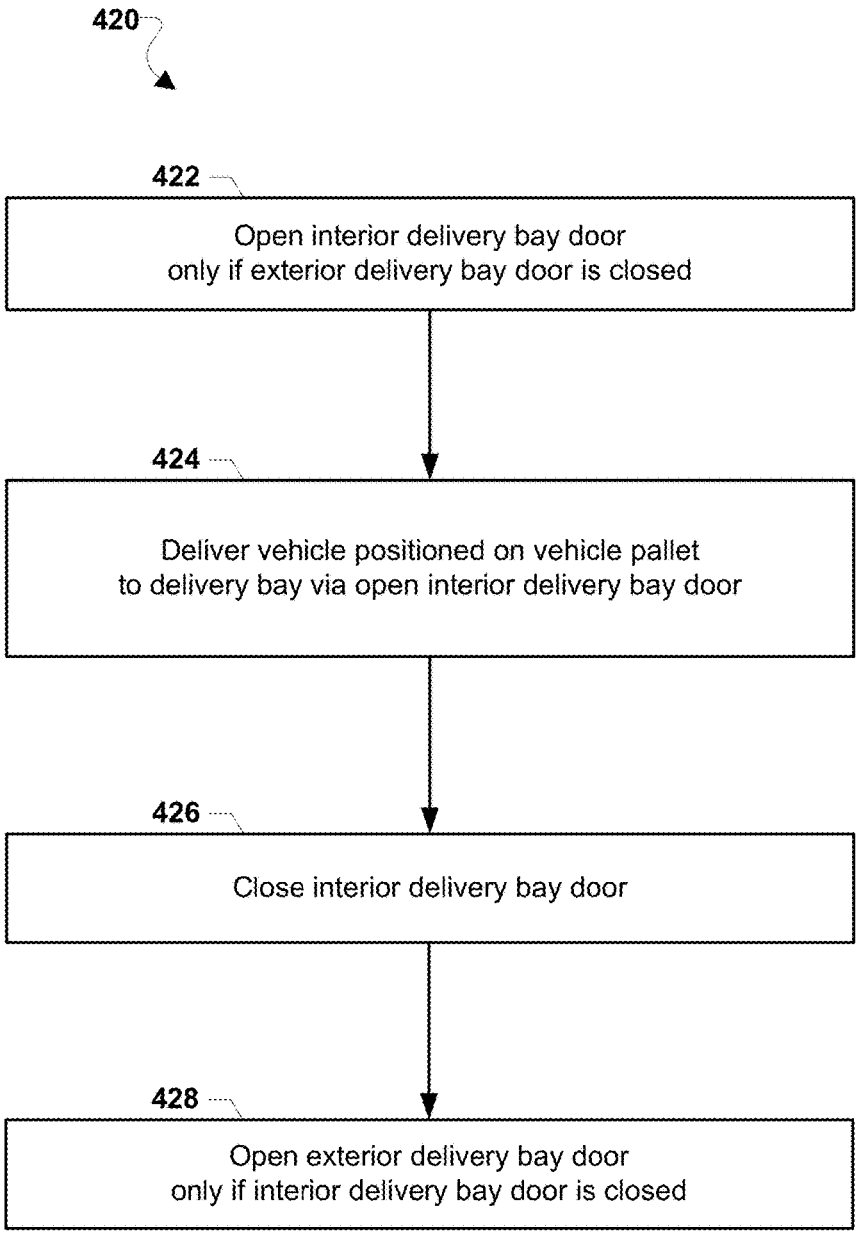

FIG. 6C illustrates a method 420 for delivering a vehicle to a delivery bay of a vehicle vending machine. With reference to FIGS. 1A-6C, the method 420 provides examples of operations that may be performed in block 406 of the method 400. The operations of the method 420 may be performed by one or more processors of a vehicle vending machine (e.g., vehicle vending machine (e.g., vending machine 100, 200, etc.)).

In block 422, an interior delivery bay door may be opened only if an exterior delivery bay door is closed. In various embodiments, conditions within an empty delivery bay or within a corridor of the vehicle vending machine may be dangerous or otherwise unfit for a customer to enter. In some embodiments, delivery of a vehicle into a delivery bay may pose a risk to an individual standing or otherwise located in the delivery bay. As such, the interior delivery bay door may only be opened if the exterior delivery bay door is closed, thus ensuring no individual is present within the delivery bay.

In block 424, a vehicle positioned on a vehicle pallet may be delivered to the delivery bay via the open interior delivery bay door. For example, a telescopic device (e.g., 204) may be extended from a robotic carrier (e.g., 114), thus pushing or otherwise moving a pallet carrier (e.g., 302) into the delivery bay.

In block 426, the interior delivery bay door may be closed. In block 428, the exterior delivery bay door may be opened only if the interior delivery bay door is closed. The corridor and other areas within the vehicle vending machine may be inappropriate for a customer or other individual without specialized training. As such, the exterior door may be opened only if the interior door is closed to ensure the safety and well-being of a customer while precluding unwanted intrusion into the corridor or other inappropriate areas of the vehicle vending machine.

Figure 6D:
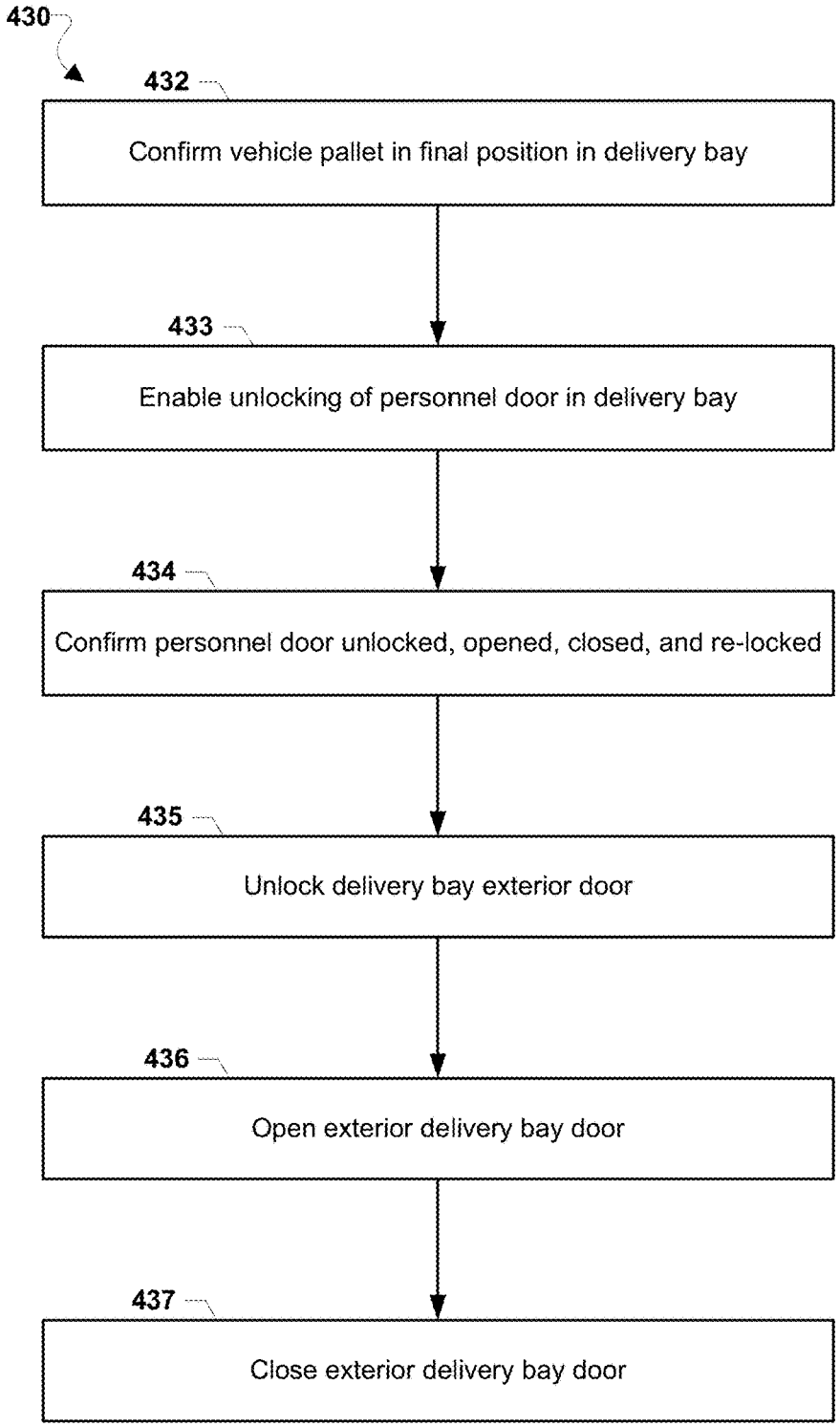

FIG. 6D illustrates a method 430 for delivering a vehicle to delivery location outside the vehicle vending machine. With reference to FIGS. 1A-6D, the method 430 provides examples of operations that may be performed in block 407 of the method 400. The operations of the method 430 may be performed by one or more processors of a vehicle vending machine (e.g., vehicle vending machine (e.g., vending machine 100, 200, etc.)). The method 430 may be performed after the carrier of the vehicle vending machine has been in operation to traverse a vehicle pallet with a vehicle on it from the tower to the delivery bay.

In block 432, the position of the vehicle pallet with the vehicle on it being in the final position in the delivery bay may be confirmed. For example, when a ball screw drive may deliver the pallet down a corridor and into the delivery bay, the pallet being in the "final position" may be indicated by an embedded encoder inside of the ball screw drive motor. The controller of the vehicle vending machine may confirm the position via outputs from the ball screw drive motor. In some embodiments, only after the pallet is confirmed in the final position may the method proceed from block 432.

In block 433, the personnel door in the delivery bay may be enabled to be unlocked. In various embodiments, while the lift-able shuttle and/or carrier of the vehicle vending machine are in operation, one or more doors to the delivery bay may remain locked, such as the external delivery bay door and the personnel door. In various embodiments, when the vehicle pallet is in the final position in the delivery bay, an employee may unlock the personnel door, such as via his or her control panel (e.g., tablet computing device). For example, the tablet computing device may indicate the personnel door is enabled to be unlocked in response to a signal from the vehicle vending machine and the employee may use the tablet computing device to unlock the personnel door. As a specific example, the signal from the tablet computing device having a specific SSID may unlock the personnel door. The employee may open the personnel door and thereby enter the delivery bay. The employee may close and lock the personnel door and enter the vehicle on the vehicle pallet.

In block 434 the unlocking, opening, closing, and relocking of the personnel door may be confirmed. This series of operations may be indicted by tracking signals from the control panel and by sensors on the personnel door itself. In some embodiments, only after the operations of unlocking, opening, closing, and relocking are confirmed may the method proceed from block 434.

In block 435, the delivery bay exterior door may be unlocked. The unlocking of the delivery bay exterior door may be automatic in response to the confirmation in block 434. In block 436, the delivery bay exterior door may be opened. For example, an employee in the vehicle may use a control panel that is a tablet computing device to open the delivery bay exterior door by pressing an open button on the graphical user interface. In response, the exterior door may slide open, and the employee may drive the vehicle off the pallet and out of the delivery bay to an external delivery position outside the vehicle vending machine. In block 437, the delivery bay exterior door may close. The closing of the door may be in response to an employee input to a control panel and/or may be automatic after removal of the vehicle from the delivery bay.

Figure 7:
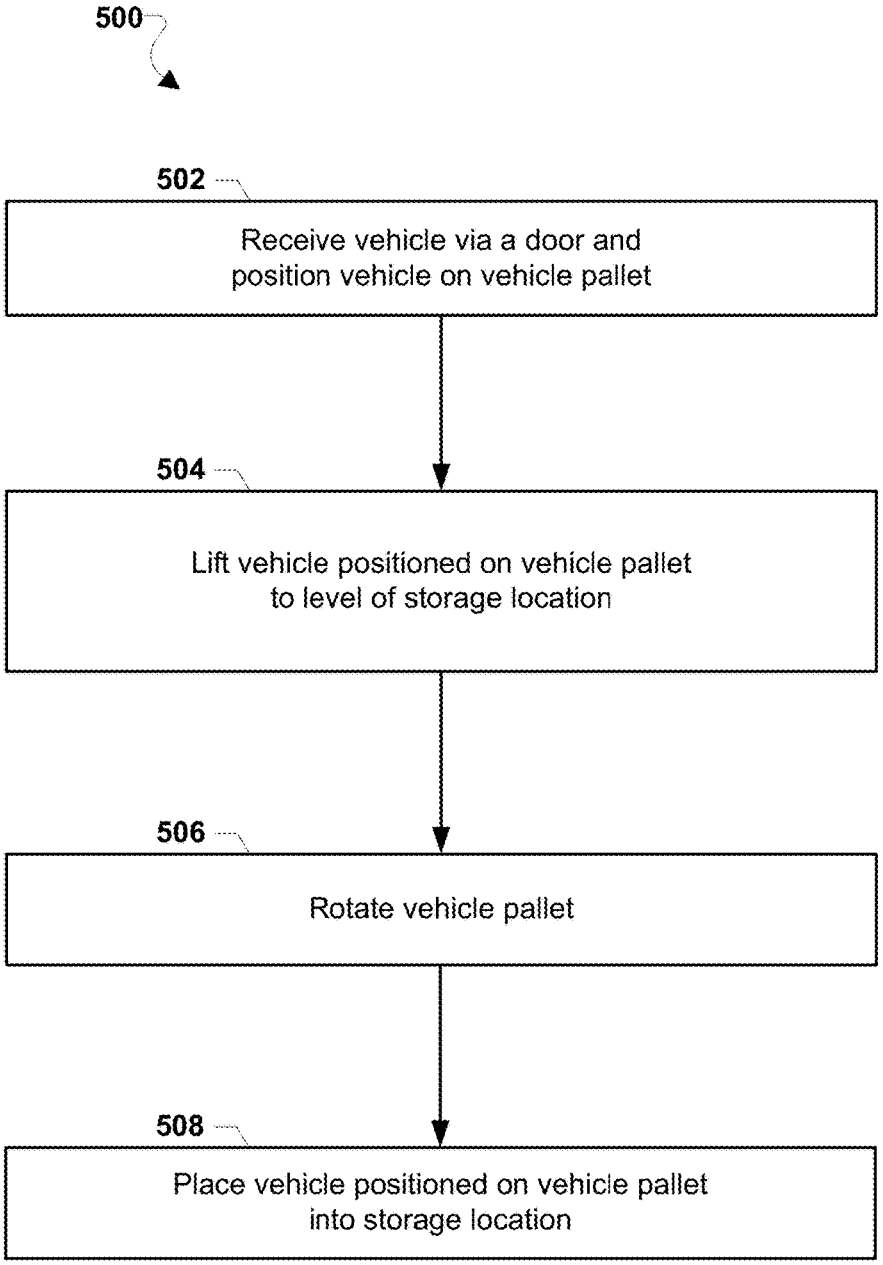
FIG. 7 is process flow diagram illustrating an example of a method for storing a vehicle in a vehicle vending machine, according to various embodiments.

FIG. 7 illustrates a method 500 for storing a vehicle in a tower of a vehicle vending machine. With reference to FIGS. 1A-7, the operations of the method 500 may be performed by one or more processors of a vehicle vending machine (e.g., vehicle vending machine (e.g., vending machine 100, 200, etc.)). In block 502, a vehicle may be received via a door of the tower (e.g., exterior door 108, tower loading door 286, etc.) and positioned on a vehicle pallet. For example, the vehicle pallet may be resting on a lift-able shuttle of the tower and the vehicle may be driven through the exterior door (or through the tower loading door from the vehicle preparation area) until the vehicle is positioned directly on the vehicle pallet. Alternatively, or in addition, the vehicle may be pushed or pulled through the door of the tower (e.g., exterior door 108, tower loading door 286, etc.) until the vehicle is positioned on the vehicle pallet. In various embodiments, the operations of block 502 may occur after the vehicle has been prepared in a vehicle preparation area and after the vehicle has been driven into the vehicle vending machine, such as into the vehicle preparation area, through an external door of the vehicle vending machine.

In block 504, the vehicle positioned on the vehicle pallet may be lifted to an appropriate level for a storage location. For example, the tower may include four (4) levels and the vehicle may need to be stored in a storage location on the third level. In some embodiments, a lift-able shuttle of the tower may be raised to the appropriate level (i.e., third level).

In block 506, the vehicle pallet is rotated to an appropriate orientation. For example, if the storage location is located along one wall of the tower and the exterior door is located along a wall opposite the storage location, the vehicle pallet (and vehicle positioned on the vehicle pallet) may be positioned perpendicular to the storage location. As such, the vehicle pallet may be rotated until the vehicle pallet (and vehicle positioned on the vehicle pallet) is oriented parallel to the storage location. In block 508, the vehicle positioned on the vehicle pallet is placed into the storage location.

Figure 8:
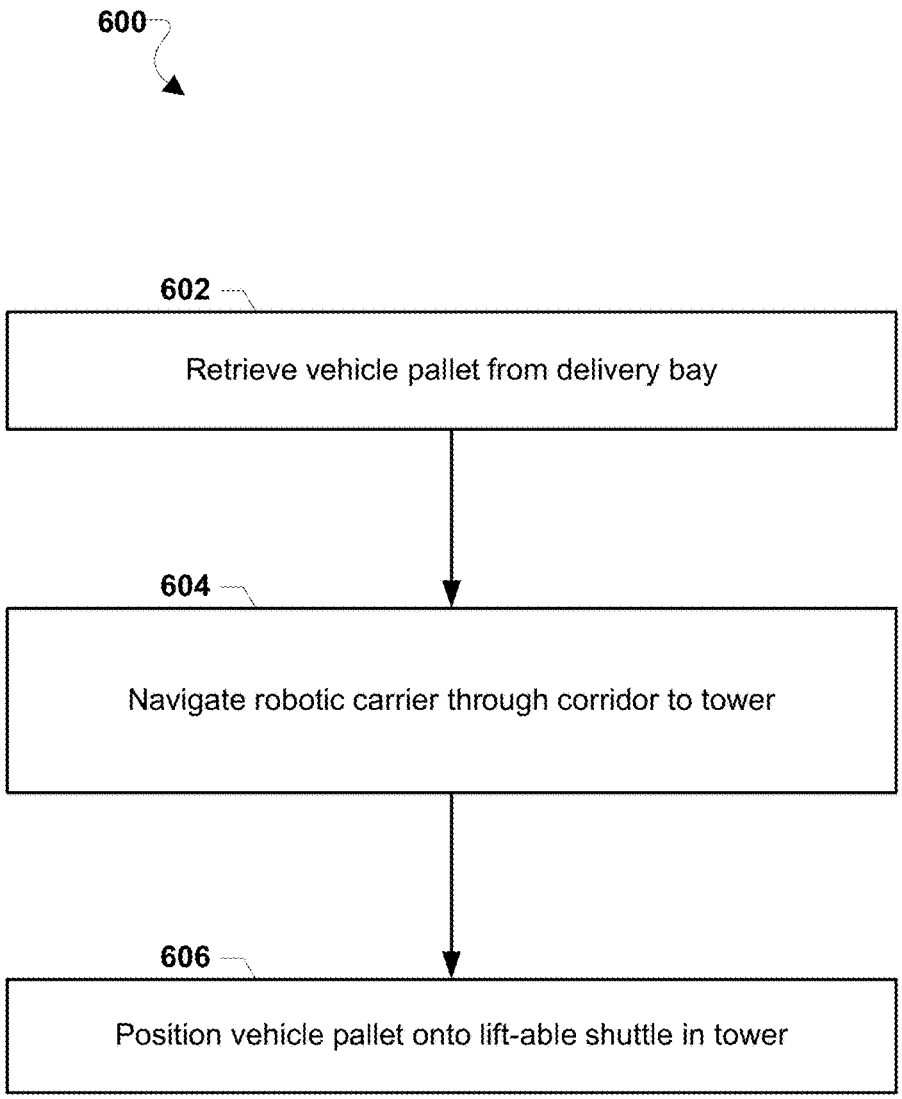
FIG. 8 is process flow diagram illustrating an example of a method for retrieving a vehicle pallet in a vehicle vending machine, according to various embodiments.

FIG. 8 illustrates a method 600 for retrieving a vehicle pallet from a delivery bay of a vehicle vending machine. With reference to FIGS. 1A-8, the operations of the method 600 may be performed by one or more processors of a vehicle vending machine (e.g., vehicle vending machine (e.g., vending machine 100, 200, etc.)). In some embodiments, the vehicle pallet may be empty. In other embodiments, a vehicle may be positioned on the vehicle pallet. For example, after inspecting or otherwise reviewing the vehicle, a customer may decide to not take delivery of the vehicle, in which case the vehicle may need to be returned to storage.

In block 602, the vehicle pallet may be retrieved from the delivery bay. In some embodiments, an interior delivery bay door may only be opened if an exterior delivery bay door is closed. In some embodiments, a telescopic device (e.g., 204) may be extended from a robotic carrier (e.g., 114) and hook or otherwise engage a pallet carrier (e.g., 302) in order to retrieve the vehicle pallet. In some embodiments, the delivery hitch (e.g., 275) may be retracted after the exterior delivery bay door is closed.

In block 604, a robotic carrier may navigate through a corridor of the vehicle vending machine. For example, after retrieving the vehicle pallet from the delivery bay, the robotic carrier may carry the vehicle pallet back through the corridor to a tower of the vehicle vending machine. As another example, the ADS may traverse a delivery hitch (e.g., 275) from the delivery bay through the corridor to the tower.

In block 606, the vehicle pallet is positioned onto a lift-able shuttle of the tower. For example, the vehicle pallet may be pushed or otherwise delivered through an opening between the tower and the corridor. Once returned to the tower, the vehicle pallet (either empty or with a vehicle positioned on the vehicle pallet) may be placed into a storage location or, if empty, a vehicle may be positioned onto the empty vehicle pallet.

Figure 9A:
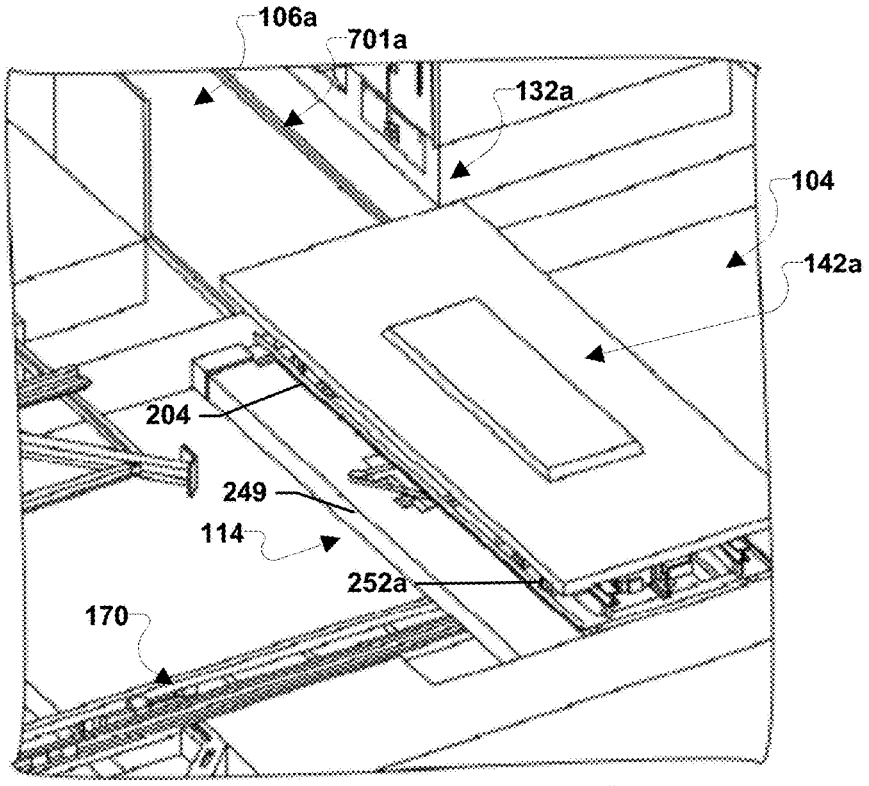
FIGS. 9A-9E illustrate movements of a vehicle pallet in a vehicle vending machine according to various embodiments.

FIGS. 9A-9E illustrate movements of a vehicle pallet in a vehicle vending machine according to various embodiments. With reference to FIGS. 1A-9E, the robotic carrier 114 for carrying a vehicle may carry the vehicle pallet 142*a* down the corridor 104 to outside delivery bay 106*a* and interior door opening 132*a* as shown in FIG. 9A. The vehicle pallets 142*a* may be supported by a pallet carrier 252*a* on the base 249 of the robotic carrier 114. The robotic carrier 114 may traverse the corridor 104 on track (or rail) 170. Tracks (or rails) 701*a* within the delivery bay 106*a* may be configured to receive the pallet carrier 252*a* supporting the vehicle pallet 142*a*. No vehicle is illustrated on the vehicle pallet 142*a* in FIGS. 9A-9E for ease of illustration; however, a vehicle for delivery to the bay 106*a* could be supported by the vehicle pallet 142*a*. The back portion of the bay 106*a* floor may split into two portions 702*a* and 703*a* that may lift up to allow the pallet carrier 252*a* supporting the vehicle pallet 142*a* to enter the bay 106*a*. When folded down, floor portions 702*a* and 703*a* may be at a height equal to the height of the vehicle pallet 142*a*, and the pallet 142*a* and floor portions 702*a* and 703*b* may form an elevated deck above the actual floor of the bay 106*a*. Additionally, the floor of the corridor 104*a* may be recessed below the actual floor of the bay.

Figure 9B:
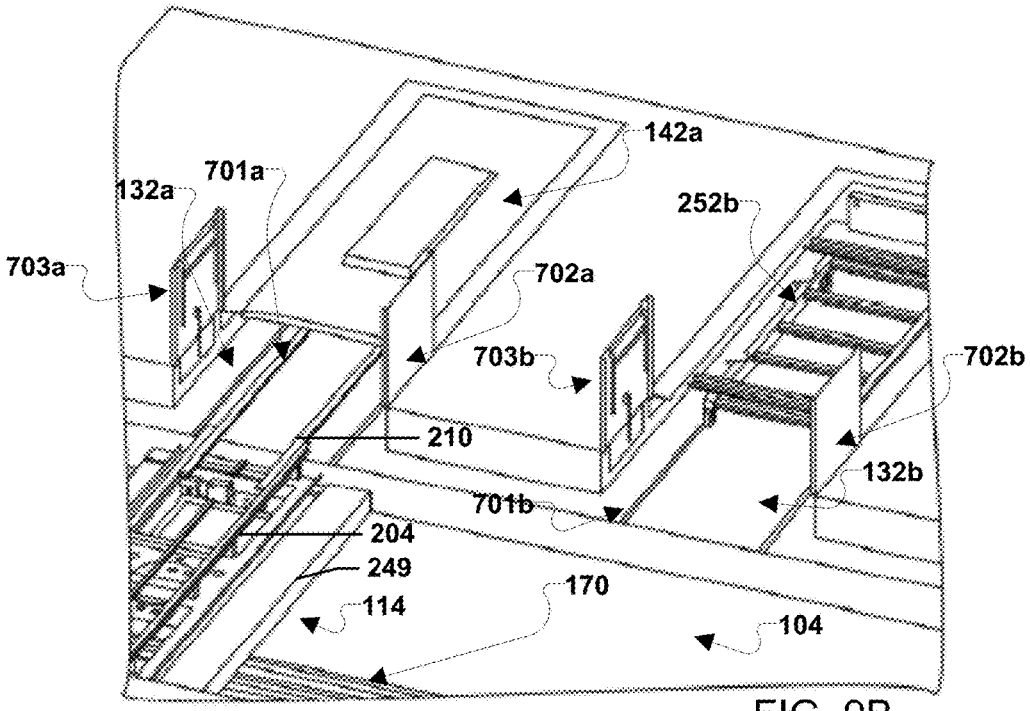

Referring to FIG. 9B, the telescopic guide arm 210 may extend from the telescopic device 204 to insert the pallet carrier 252*a* and vehicle pallet 142*a* into the bay 106*a*. The pallet carrier 252*a* may slide along the tracks (or rails 701*a*) in the bay 106*a*. FIG. 9B also illustrates a second pallet carrier 252*b* in bay 106*b* ready for pick-up by the robotic carrier 114.

In various embodiments, the delivery bays 106*a* and 106*b* are placed one next to the other alongside the corridor 104. The delivery bays include access doors, as well as floor compensation mechanisms. The floor in the delivery bays is prepared with a pit in the right size for the reception of the pallet carriers 252 bringing the vehicle on a pallet 146. The delivery bays may have 2 gates, the back- and the front-doors or gates. These doors are integrated in the automation of the vehicle vending machine and include a back and front gate. The front gate is the access for the customer from the street, and the back gate is a safety barrier closing the access of people to the area where the moving parts of the vehicle vending machine operate. Gates may include safety features such as manual opening, emergency stop, contact strips, etc. The back-gate enables the access of the pallet carriers 252 from the corridor 104 into the bays 106*a-d*. After placing the vehicle in the bay 106*a*, the telescopic guide arm 210 retracts and the back-gate to the corridor 104 will close automatically. The position of the pallet 142*a* may be calculated by the motor-inverter of the robotic carrier 114. After the pallet 142*a* is correctly placed, the floor compensation mechanism formed from the two floor portions 702*a* and 703*a* will be activated. This closes the pit behind the car pallet 142*a* to enable a flat a level surface all around the car for the customer to transit the area. For example, the floor mechanism may be 2-leaf hatch formed from floor portions 702*a* and 703*a*, each leaf controlled by electric motors. An inductive sensor per electrical motor may signal that the hatch is closed allowing the front door to unlock. The same sensor signal position open allowing the back door to open and the robotic carrier 114 to bring in the car pallet 142*a*. The vehicle vending machine may only unlock the front-gate when the car is safely parked in the delivery bay, the robotic carrier 114 has left the bay, and the back-gate is closed. The actual opening of the front-gate may be executed by an employee via a control panel when the customer is in place. When the employee leaves the bay, he or she may close the gate via the control panel. After a visual inspection of the inside of the bay, if there are neither obstacles nor people in the bay, the employee may give clearance to the vehicle vending machine via the control panel and the empty pallet will be picked up at the next possibility.

Figure 9C:
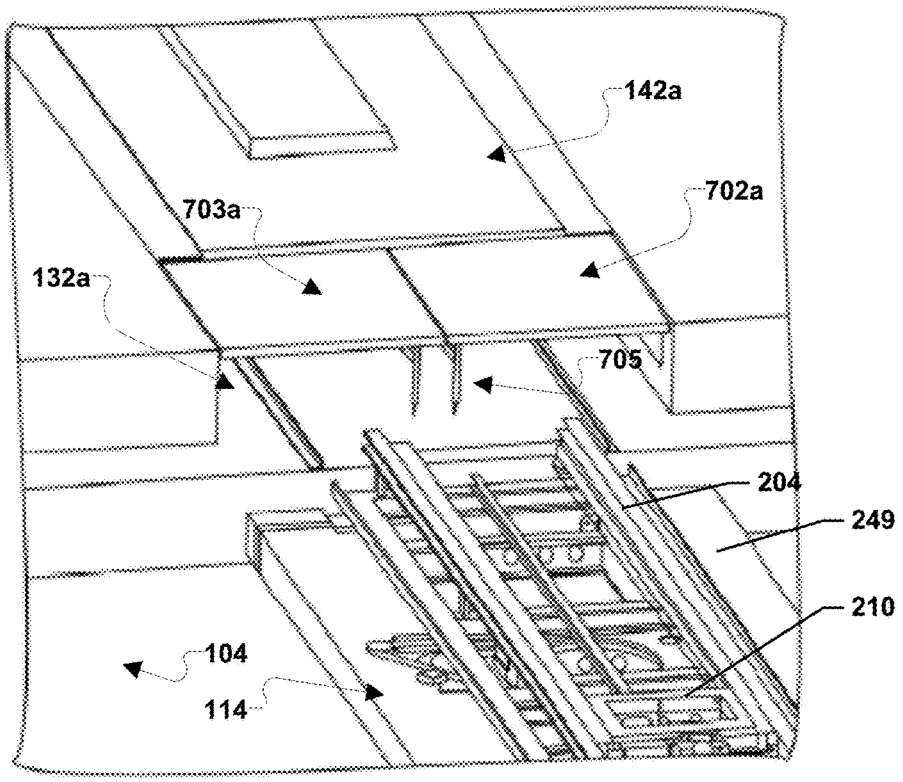
Figure 9D:
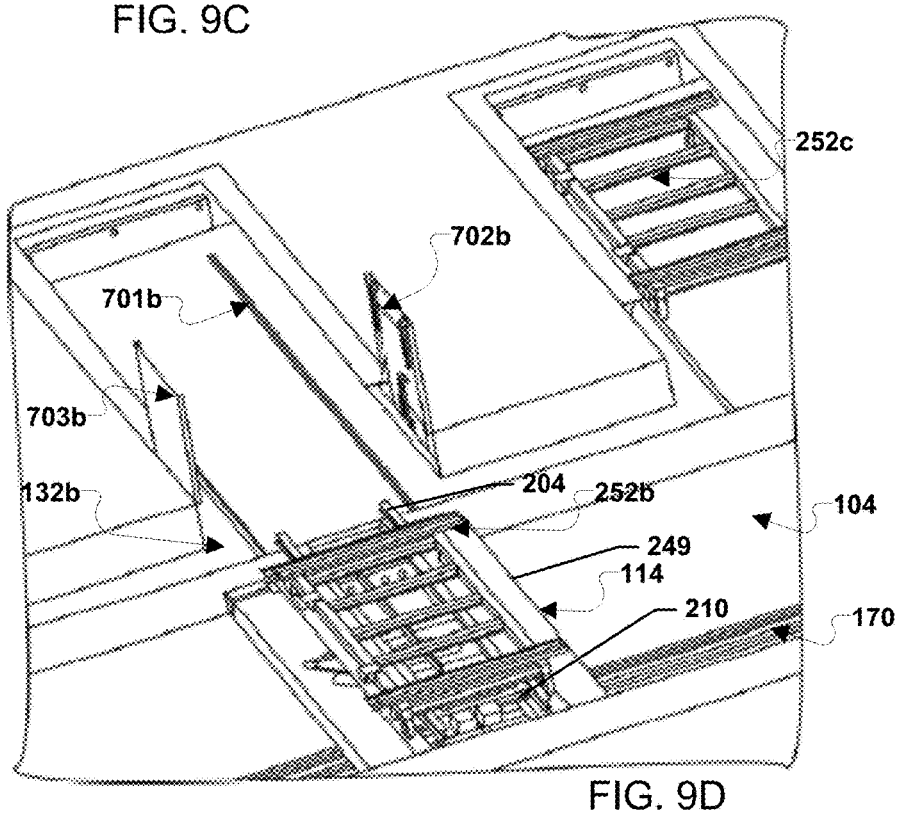
Figure 9E:
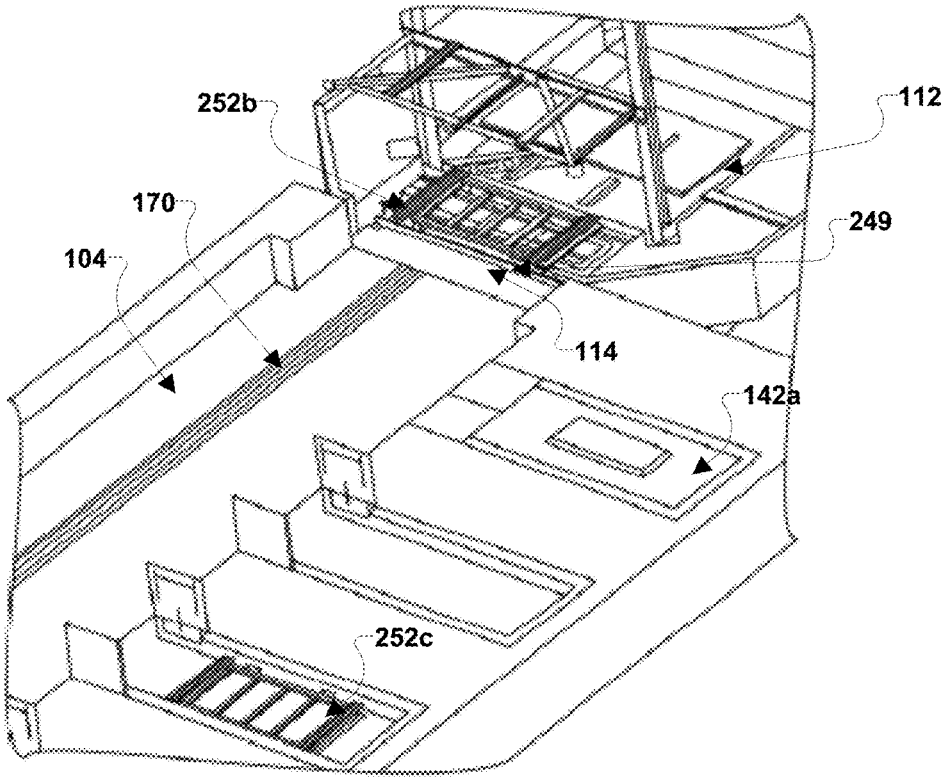

FIG. 9C illustrates the floor portions 702*a* and 703*a* in a closed position and supported above the bay 106*a* floor by legs 705. The telescopic guide arm 210 is retracted back into the robotic carrier 114. FIG. 9D shows the robotic carrier 114 retrieving the pallet carrier 252*b* from the bay 106*b*. Floor portions 702*b* and 703*b* of bay 106*b* are elevated and open and the pallet carrier 252*b* is retracted with the telescopic guide arm 210 back on the robotic carrier 114. A third pallet carrier 252*c* in another bay is also visible in FIG. 9D. FIG. 9E shows the robotic carrier 114 after traversing the corridor 104 back to the tower 102 to await delivery of another vehicle pallet and vehicle onto the pallet carrier 252*b*. The robotic carrier 114 moved from bay 106*b* to the tower 102 and is positioned next to the lift-able shuttle 112 to receive a vehicle pallet and vehicle.

Figure 10A:
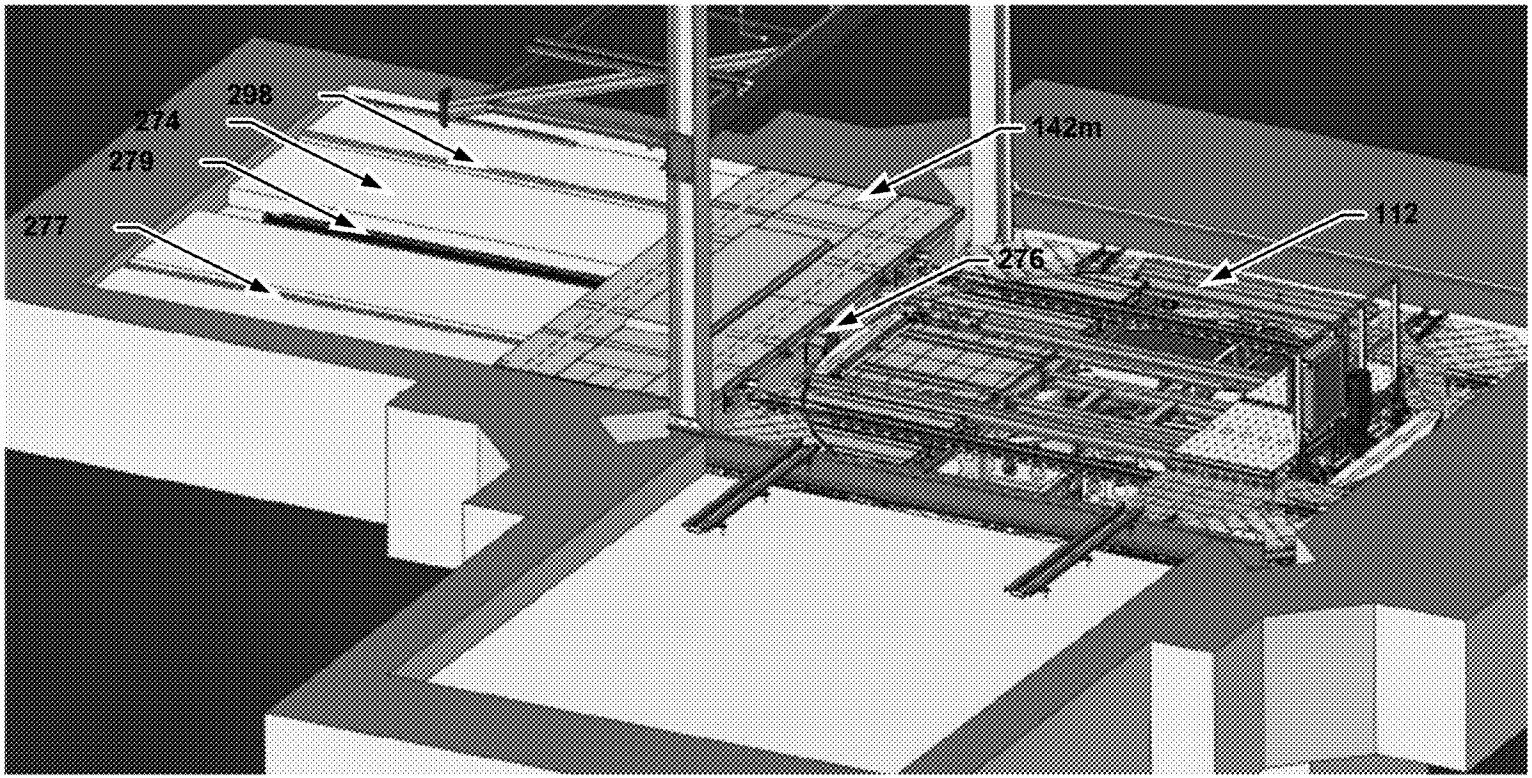
FIGS. 10A and 10B are block diagrams illustrating components of a vehicle vending machine robotic carrier system that uses a delivery hitch according to various embodiments.
Figure 10B:
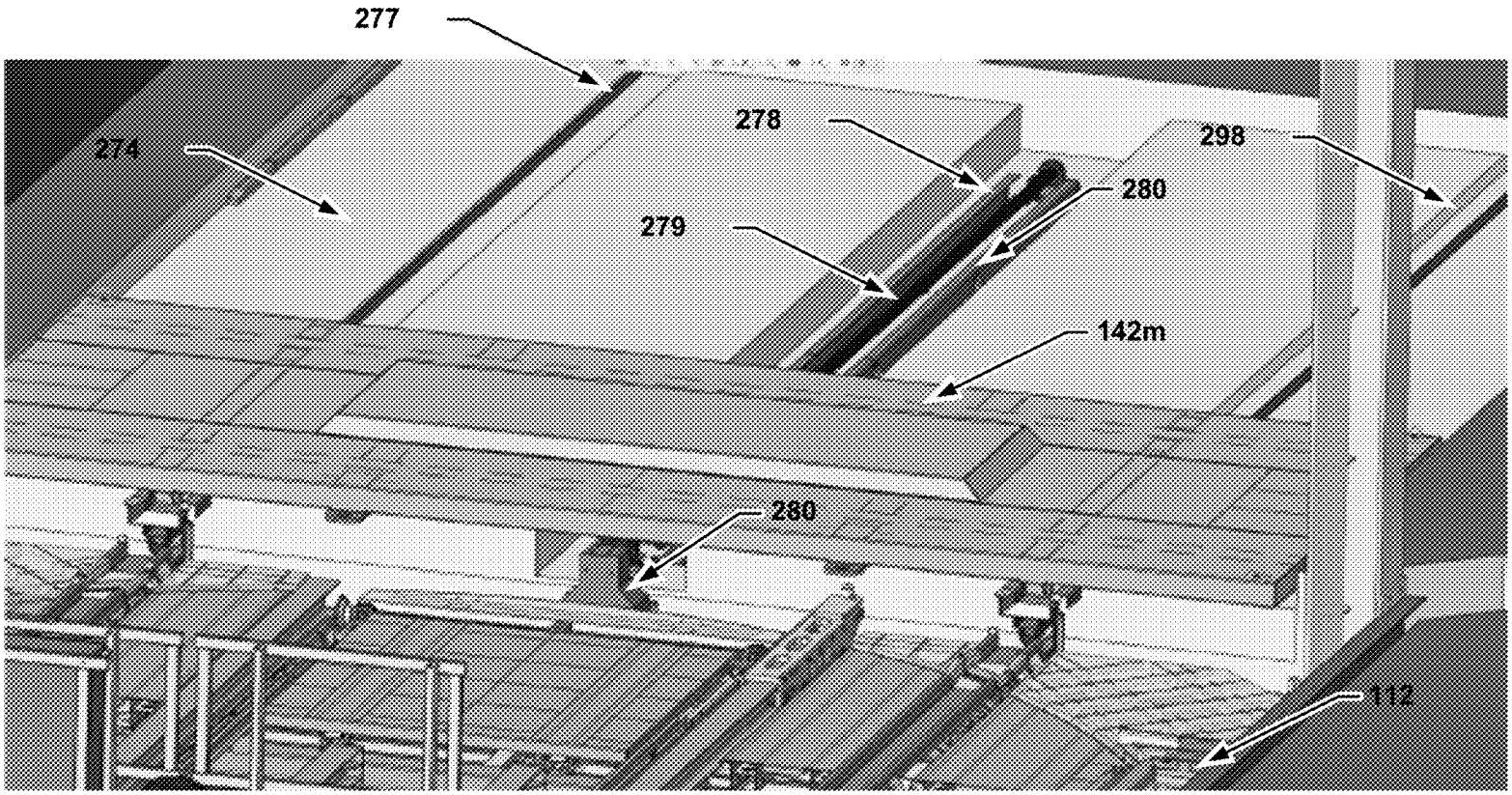

FIGS. 10A and 10B are block diagrams illustrating components of a vehicle vending machine robotic carrier system that uses a delivery hitch according to various embodiments. Specifically, FIGS. 10A and 10B illustrate different views of a carrier, such as an ADS 274, that may be arranged in the corridors leading to the delivery bays in a vehicle vending machine, such as vehicle vending machine 200. FIGS. 10A and 10B show an empty vehicle pallet 142*m* that has been moved from the lift-able shuttle 112 into a corridor for transport to a delivery bay. The ADS 274 may be a robotic carrier configured to traverse the pallet 142*m* from the lift-able shuttle 112 in the tower through a respective corridor and into a respective delivery bay and back again. The ADS 274, a type of robotic carrier, may be a delivery hitch 275 that may a linear delivery system driven by a ball screw 279 and guided by two track roller guide rails 278 and 280. The delivery hitch 275 may be connected to the guide tracks 278, 280 via four profiled track rollers on a shaft, and two flat track rollers onto the top of the guide track channel. There may be a guide track 278, 280 on two sides of the delivery hitch 275, and a ball screw 279 that lies on the central axis of this carrier system. The delivery hitch 275 may have six track rollers. Two track rollers may be steel ball bearings with a flat outer bearing contact surface. Four track rollers may be steel ball bearings with a profiled outer bearing contact surface to provide the hitch 275 with lateral stability when paired with a shaft. The drive motor 276 of the ball screw 279 may have a built-in encoder, when paired with the pitch of the ball screw 279, that may provide constant knowledge of the position of the pallet on the carrier. The range of travel of the delivery hitch 275 may be programmed into the system to prevent over-travel. There may be a proximity switch that detects when a pallet is properly loaded onto the delivery hitch 275. Once the pallet is positioned onto the delivery hitch 275, it will depress a spring-loaded steel plate that will position in front of the proximity switch. This switch may then send the "OK" signal to the system to proceed with delivery operations.

In various embodiments, the corridors connecting the tower to the delivery bays, respectively, may be prepared with a recess which will allow for the top of the pallet 142*m* to be flush with the floor of the delivery bays. Additionally, the recessed portion of the delivery bays floors may have a pit that lies along the centerline of the bays which may house portions of the robotic carrier (e.g., ADS 274 and its associated equipment). The corridors may be configured not to be transited by any customers or employees. Once the pallet 142*m* is correctly placed onto the carrier (e.g., on delivery hitch 275), a signal may be sent to the control system via a proximity sensor to initiate the remaining sequence to move the pallet 142*m* into the respective delivery bay. Once this sequence is initiated, the ball screw drive 279 may deliver the pallet 142*m* down the corridor into the respective delivery bay into a "final position" which may be indicated by an embedded encoder inside of the ball screw drive motor 276. Wheels on the underside of the vehicle pallet 142*m* may be arranged perpendicular to the storage direction of a vehicle on the pallet 142*m* and may slide along rails or tracks 277 and 298 extending through the corridor and into the delivery bay to enable to the pallet 142*m* to be moved laterally through the corridor and delivery bay by the movement of the delivery hitch 275 driven by the rotation of the ball screw 279 shaft.

Figure 11:
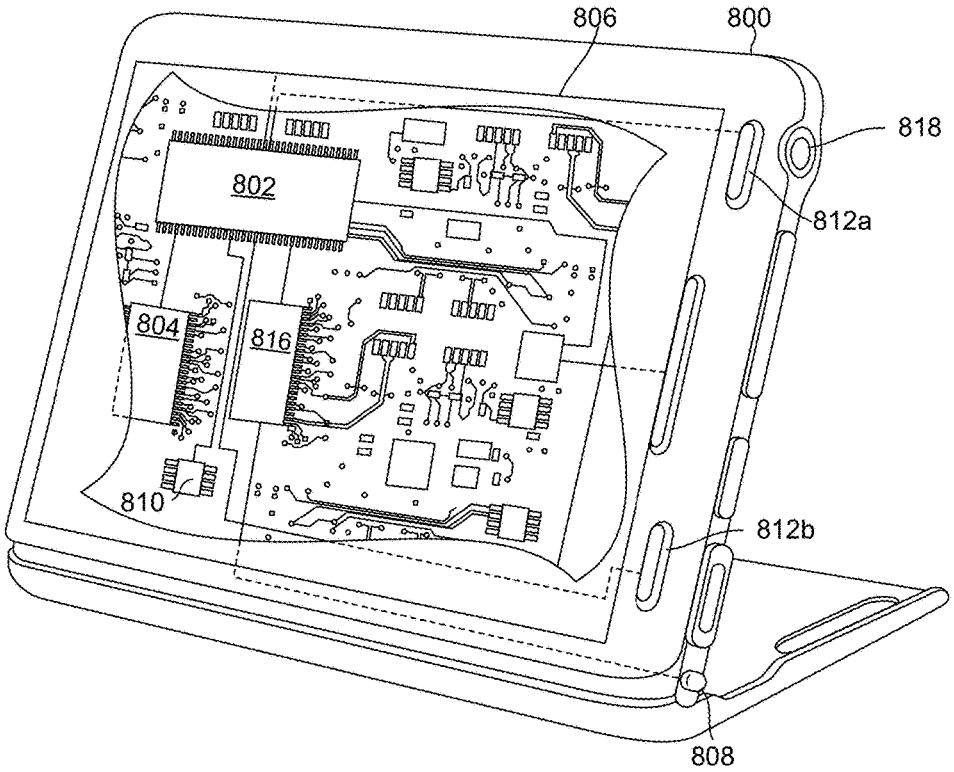
FIG. 11 is a component diagram of an example computing device suitable for use with the various embodiments.

The various embodiments may be implemented in any of a variety of computing devices, an example of which is illustrated in FIG. 11. For example, a computing device may be a mobile device 800 which may include a processor 802 coupled to internal memories 804 and 810. Internal memories 804 and 810 may be volatile or non-volatile memories, and may also be secure and/or encrypted memories, or unsecure and/or unencrypted memories, or any combination thereof. The processor 802 may also be coupled to a touch screen display 806, such as a resistive-sensing touch screen, capacitive-sensing touch screen infrared sensing touch screen, or the like. Additionally, the display of the mobile device 800 need not have touch screen capability. Additionally, the mobile device 800 may have one or more antenna 808 for sending and receiving electromagnetic radiation that may be connected to network interface, such as a wireless data link and/or cellular telephone transceiver 816, coupled to the processor 802. The mobile device 800 may also include physical buttons 812*a* and 812*b* for receiving user inputs. The mobile device 800 may also include a power button 818 for turning the mobile device 800 on and off.

Figure 12:
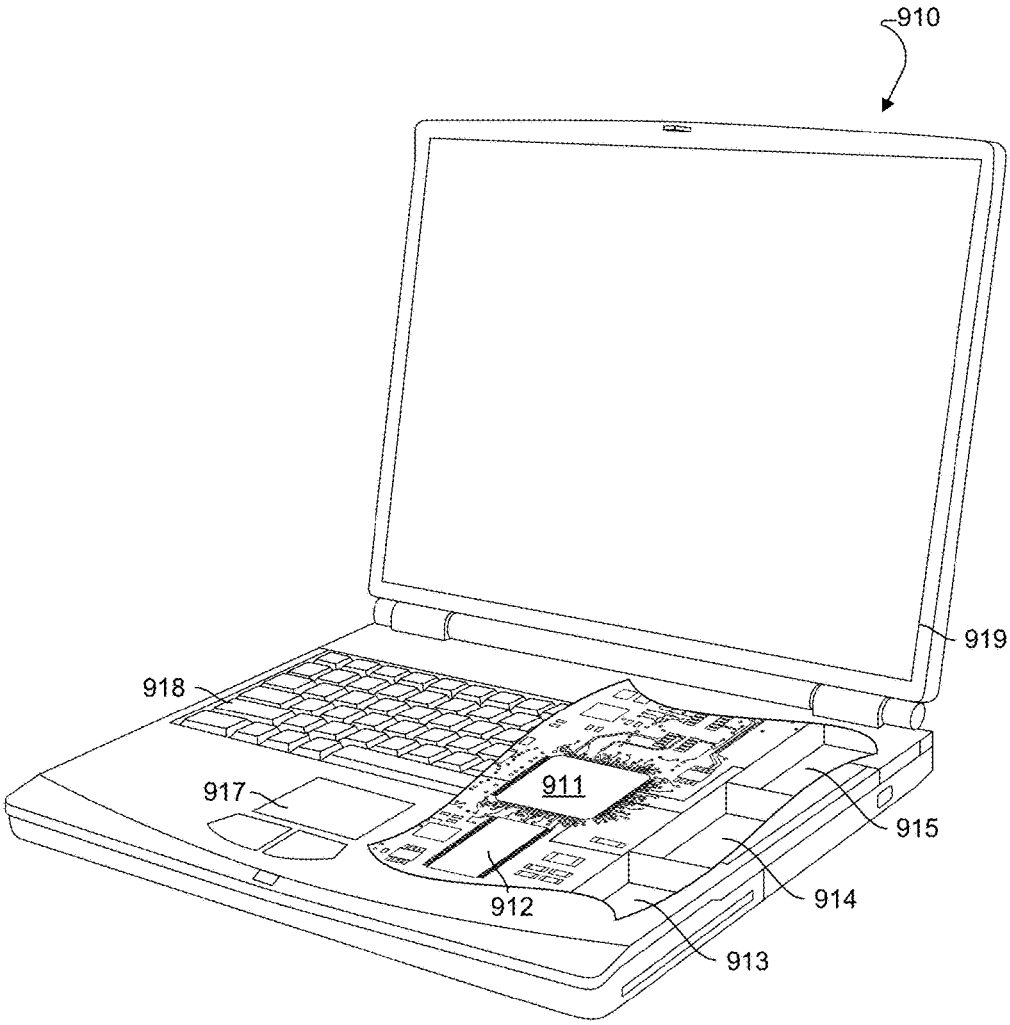
FIG. 12 is a component diagram of another example computing device suitable for use with the various embodiments.

The various embodiments described above may also be implemented within a variety of computing devices, such as a laptop computer 910 as illustrated in FIG. 12. Many laptop computers include a touchpad touch surface 917 that serves as the computer's pointing device, and thus may receive drag, scroll, and flick gestures similar to those implemented on mobile computing devices equipped with a touch screen display and described above. A laptop computer 910 will typically include a processor 911 coupled to volatile memory 912 and a large capacity nonvolatile memory, such as a disk drive 913 of Flash memory. The laptop computer 910 may also include a floppy disc drive 914 and a compact disc (CD) drive 915 coupled to the processor 911. The laptop computer 910 may also include a number of connector ports coupled to the processor 911 for establishing data connections or receiving external memory devices, such as a USB or FireWire® connector sockets, or other network connection circuits (e.g., interfaces) for coupling the processor 911 to a network. In a notebook configuration, the computer housing may include the touchpad 917, the keyboard 918, and the display 919 all coupled to the processor 911. Other configurations of the computing device may include a computer mouse or trackball coupled to the processor (e.g., via a USB input) as are well known, which may also be used in conjunction with the various embodiments.

Figure 13:
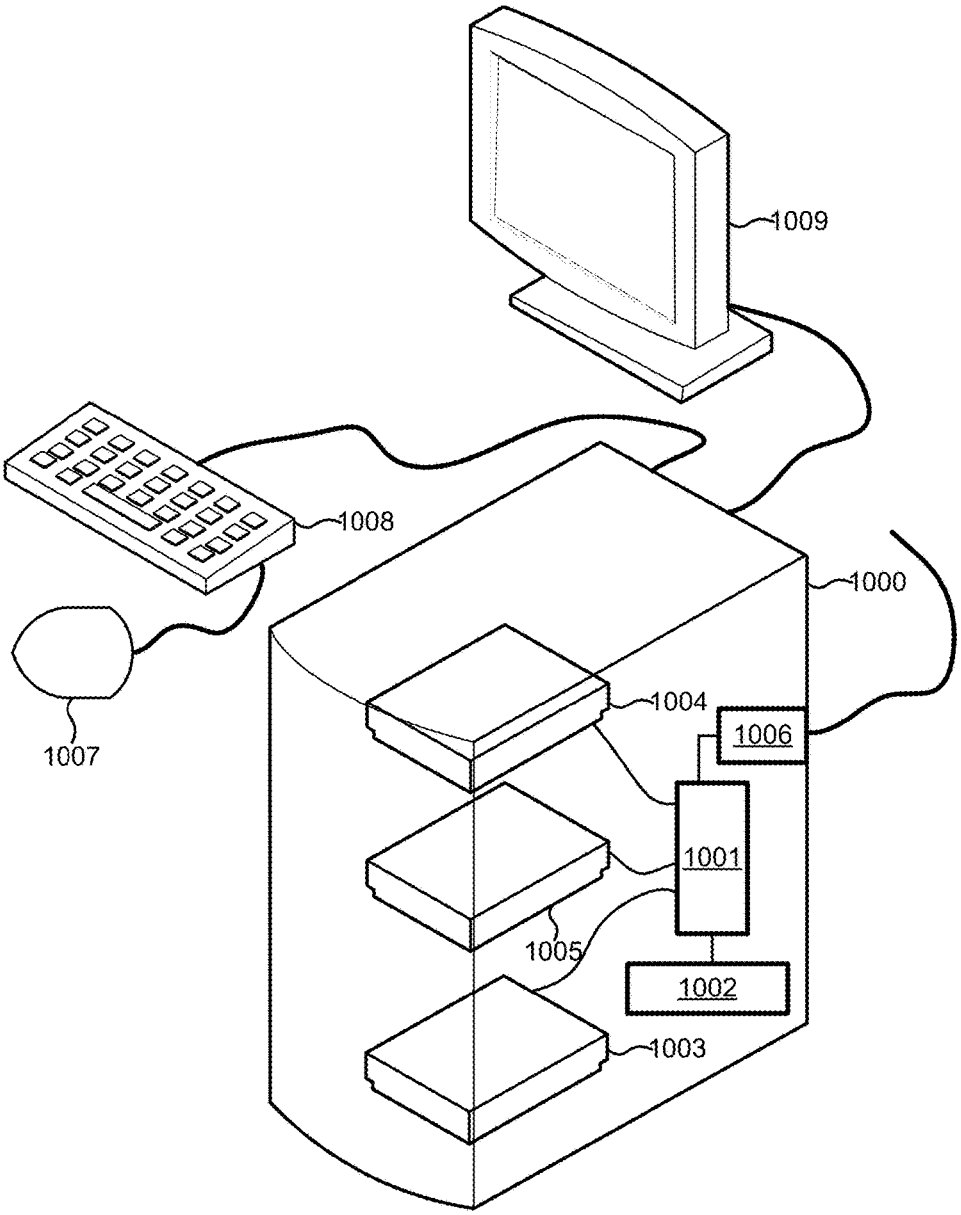
FIG. 13 is a component diagram of an additional example computing device suitable for use with the various embodiments.

The various embodiments described above may also be implemented within a variety of computing devices, such as a terminal computer 1000 as illustrated in FIG. 13. A terminal computer 1000 will typically include a processor 1001 coupled to volatile memory 1002 and a large capacity nonvolatile memory, such as a disk drive 1004 of Flash memory. The terminal 1000 may also include a floppy disc drive 1005 and a compact disc (CD) drive 1003 coupled to the processor 1001. The terminal 1000 may also include a number of connector ports 1006 coupled to the processor 1001 for establishing data connections or receiving external memory devices, such as a USB or FireWire® connector sockets, or other network connection circuits (e.g., interfaces) for coupling the processor 1011 to a network. Additionally, a keyboard 1008, mouse 1007, and display 1019 may all be coupled to the processor 1001.

Figure 14:
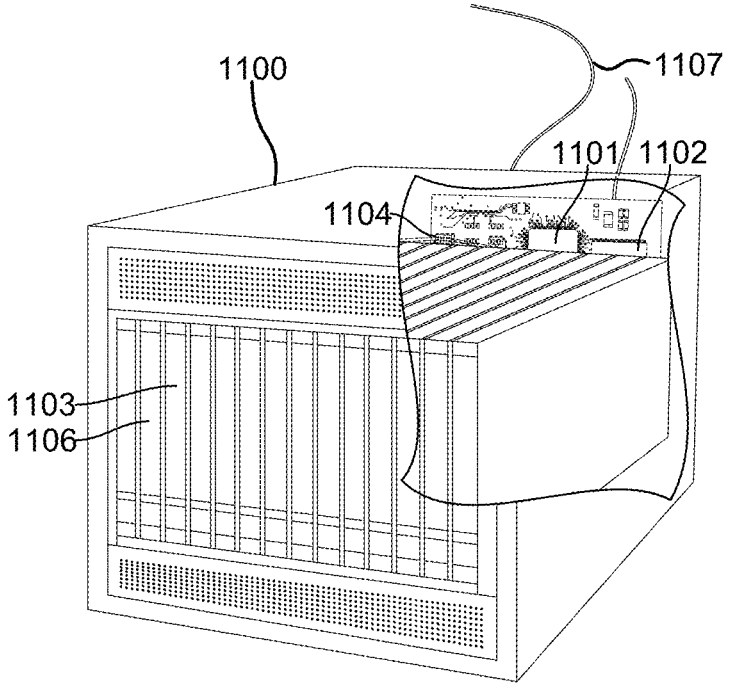
FIG. 14 is a component diagram of an example server suitable for use with the various embodiments.

The various embodiments may also be implemented on any of a variety of commercially available server devices, such as the server 1100 illustrated in FIG. 14. Such a server 1100 typically includes a processor 1101 coupled to volatile memory 1102 and a large capacity nonvolatile memory, such as a disk drive 1103. The server 1100 may also include a floppy disc drive, compact disc (CD) or DVD disc drive 1106 coupled to the processor 1101. The server 1100 may also include network access ports 1104 (network interfaces) coupled to the processor 1101 for establishing network interface connections with a network 1107, such as a local area network coupled to other computers and servers, the Internet, the public switched telephone network, and/or a cellular data network (e.g., CDMA, TDMA, GSM, PCS, 3G, 4G, LTE, or any other type of cellular data network).

The processors 802, 911, 1001, and 1101 may be any programmable microprocessor, microcomputer or multiple processor chip or chips that can be configured by software instructions (applications) to perform a variety of functions, including the functions of the various embodiments described above. In some devices, multiple processors may be provided, such as one processor dedicated to wireless communication functions and one processor dedicated to running other applications. Typically, software applications may be stored in the internal memory before they are accessed and loaded into the processors 802, 911, 1001, and 1101. The processors 802, 911, 1001, and 1101 may include internal memory sufficient to store the application software instructions. In many devices the internal memory may be a volatile or nonvolatile memory, such as flash memory, or a mixture of both. For the purposes of this description, a general reference to memory refers to memory accessible by the processors 802, 911, 1001, and 1101 including internal memory or removable memory plugged into the device and memory within the processor 802, 911, 1001, and 1101 themselves.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The hardware used to implement the various illustrative logics, logical blocks, modules, and circuits described in connection with the aspects disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Alternatively, some steps or methods may be performed by circuitry that is specific to a given function.

In one or more exemplary aspects, the functions described may be implemented in hardware, software, firmware, or any combination thereof. If implemented in software, the functions may be stored as one or more processor-executable instructions or code on a non-transitory computer-readable medium, non-transitory processor-readable medium, or non-transitory processor-readable storage medium. The steps of a method or algorithm disclosed herein may be embodied in a processor-executable software module which may reside on a non-transitory computer-readable or processor-readable storage medium. Non-transitory computer-readable or processor-readable storage media may be any storage media that may be accessed by a computer or a processor. By way of example but not limitation, such non-transitory computer-readable or processor-readable media may include RAM, ROM, EEPROM, FLASH memory, CD-ROM or other optical disk storage, magnetic disk storage or other magnetic storage devices, or any other medium that may be used to store desired program code in the form of instructions or data structures and that may be accessed by a computer. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above are also included within the scope of non-transitory computer-readable and processor-readable media. Additionally, the operations of a method or algorithm may reside as one or any combination or set of codes and/or instructions on a non-transitory processor-readable medium and/or computer-readable medium, which may be incorporated into a computer program product.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

What is claimed is:

1. A vehicle vending machine, comprising:

a first delivery bay;

a tower comprising a series of storage locations on different vertically arranged levels, wherein at least a portion of the series of storage locations are on at least one of the different vertically arranged levels of the tower that is vertically offset from the first delivery bay;

a first robotic carrier configured to move a vehicle pallet between the tower and the first delivery bay;

a second delivery bay; and a second robotic carrier configured to move a vehicle pallet between the tower and the second delivery bay, wherein the first robotic carrier and the second robotic carrier each comprise a respective delivery hitch configured to move a vehicle pallet.

2. The vehicle vending machine of claim 1, wherein the second delivery bay is oriented ninety degrees to the first delivery bay relative to the tower.

3. A vehicle vending machine, comprising:

a first delivery bay; and a tower comprising a series of storage locations on different vertically arranged levels, wherein at least a portion of the series of storage locations are on at least one of the different vertically arranged levels of the tower that is vertically offset from the first delivery bay;

a vehicle preparation area;

an exterior door providing access to the vehicle preparation area from outside the vehicle vending machine; and a tower loading door providing access to the tower from the vehicle preparation area, wherein the first delivery bay comprises:

a personnel door; and a delivery bay exterior door, wherein the personnel door and the delivery bay door are separate accesses to the first delivery bay from outside the vehicle vending machine.

4. A method for operating a vehicle vending machine, comprising:

receiving, via an exterior door of the tower of the vehicle vending machine, a vehicle into a vehicle preparation area of the vehicle vending machine, wherein the vehicle preparation area is separated from the tower by a loading door of the tower;

receiving, via the loading door of the tower, the vehicle for storage in a storage location within the tower, the vehicle being positioned on a vehicle pallet;

lifting the vehicle positioned on the vehicle pallet to an appropriate level of the tower with a lift-able shuttle of the tower;

rotating the vehicle pallet to an appropriate orientation;

placing the vehicle positioned on the vehicle pallet in a storage location;

retrieving the vehicle positioned on the vehicle pallet from the storage location within the tower;

navigating a robotic carrier to an appropriate one of a plurality of delivery bays of the vehicle vending machine while the robotic carrier carries the vehicle positioned on the vehicle pallet;

wherein:

the plurality of delivery bays are a first delivery bay and a second delivery bay;

the robotic carrier is one of a first robotic carriers associated with the first delivery bay or a second robotic carrier associated with the second delivery bay according to which of the first or second delivery bays is the appropriate delivery bay.

5. The method of claim 4, wherein retrieving a vehicle positioned on a vehicle pallet from a storage location within a tower of the vehicle vending machine comprises:

retrieving the vehicle positioned on the vehicle pallet from the storage location with a lift-able shuttle;

rotating the vehicle pallet to an appropriate orientation; and positioning the vehicle positioned on the vehicle pallet onto the robotic carrier.

6. The method of claim 5, wherein the first robotic carrier and the second robotic carrier each comprise a respective delivery hitch configured to move the vehicle pallet.

7. The method of claim 6, wherein the storage location is vertically offset from the plurality of delivery bays.

8. The method of claim 7, further comprising:

unlocking a personnel door in the appropriate delivery bay in response to determining the vehicle positioned on the vehicle pallet is in a final position in the appropriate delivery bay; and opening an external door of the appropriate delivery bay in response to the personnel door being relocked after its unlocking.

9. The method of claim 8, further comprising:

closing the external door of the appropriate delivery bay after confirmation that the vehicle is removed from the appropriate delivery bay.

* * * * *